US009803457B2

(12) United States Patent
Shampine et al.

(10) Patent No.: US 9,803,457 B2
(45) Date of Patent: Oct. 31, 2017

(54) SYSTEM AND METHOD FOR DELIVERING TREATMENT FLUID

(75) Inventors: Rod Shampine, Houston, TX (US); Edward Leugemors, Needville, TX (US); Timothy Lesko, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 117 days.

(21) Appl. No.: 13/415,025

(22) Filed: Mar. 8, 2012

(65) Prior Publication Data

US 2013/0233542 A1 Sep. 12, 2013

(51) Int. Cl.
*E21B 43/267* (2006.01)
*E21B 43/26* (2006.01)

(52) U.S. Cl.
CPC ..... *E21B 43/26* (2013.01); *E21B 43/267* (2013.01)

(58) Field of Classification Search
CPC ..... E21B 43/267; E21B 43/26; E21B 43/04; E21B 43/128; E21B 43/25
See application file for complete search history.

(56) References Cited

U.S. PATENT DOCUMENTS

| | | | |
|---|---|---|---|
| 2,193,775 | A | 3/1940 | Stratford |
| 2,513,944 | A | 7/1950 | Kessler |
| RE24,570 | E | 11/1958 | Mangold et al. |
| 2,905,245 | A | 9/1959 | Depriester |
| 3,362,475 | A | 1/1968 | Huitt et al. |
| 3,434,540 | A | 3/1969 | Stein |
| 3,675,717 | A | 7/1972 | Goins et al. |
| 3,887,474 | A | 6/1975 | Senfe |
| 3,937,283 | A | 2/1976 | Blauer et al. |
| 4,051,900 | A | 10/1977 | Hankins |
| 4,387,769 | A | 6/1983 | Erbstoesser et al. |
| 4,506,734 | A | 3/1985 | Nolte |
| 4,526,695 | A | 7/1985 | Erbstoesser et al. |
| 4,606,407 | A | 8/1986 | Shu |
| 4,652,257 | A | 3/1987 | Change |
| 4,665,988 | A | 5/1987 | Murphey et al. |

(Continued)

FOREIGN PATENT DOCUMENTS

| | | | |
|---|---|---|---|
| CA | 2710988 | A1 | 7/2009 |
| CN | 1280240 | A | 1/2001 |

(Continued)

OTHER PUBLICATIONS

International Search Report and Written Opinion issued in PCT/US2013/029822 on Jul. 4, 2014, 17 pages.

(Continued)

*Primary Examiner* — Zakiya W Bates
(74) *Attorney, Agent, or Firm* — Michael L. Flynn; Rachel E. Greene; Robin Nava

(57) ABSTRACT

The current application aims at methods and systems for preparing a pump-ready treatment fluid, delivering the pump-ready treatment fluid to a location operationally coupled to a wellsite, providing the pump-ready treatment fluid to a pump; and pumping the pump-ready treatment fluid into a wellbore. In some embodiments, the treatment fluid is a fracturing fluid for conducting a hydraulic fracturing operation on a subterranean formation penetrated by a wellbore.

11 Claims, 7 Drawing Sheets

(56) References Cited

U.S. PATENT DOCUMENTS 4,670,166 A 6/1987 McDougall et al.
4,718,490 A 1/1988 Uhri
4,738,897 A 4/1988 McDougall et al.
4,785,884 A 11/1988 Armbruster
4,845,981 A 7/1989 Pearson
4,848,467 A 7/1989 Cantu et al.
4,867,241 A 9/1989 Strubhar
4,883,124 A 11/1989 Jennings
4,917,185 A 4/1990 Jennings et al.
4,951,751 A 8/1990 Jennings
4,957,165 A 9/1990 Cantu et al.
4,968,353 A 11/1990 Kawasaki et al.
4,968,354 A 11/1990 Nishiura et al.
4,977,961 A 12/1990 Avasthi et al.
4,986,355 A 1/1991 Casad et al.
5,036,920 A 8/1991 Cornette et al.
5,095,987 A 3/1992 Weaver et al.
5,161,618 A 11/1992 Jones et al.
5,188,837 A 2/1993 Domb
5,238,067 A 8/1993 Jennings
5,551,516 A 9/1993 Norman et al.
5,325,921 A 7/1994 Johnson et al.
5,330,005 A 7/1994 Card et al.
5,332,037 A 7/1994 Schmidt et al.
5,333,689 A 8/1994 Jones et al.
5,365,435 A 11/1994 Stephenson
5,415,228 A 5/1995 Price et al.
5,439,055 A 8/1995 Card et al.
5,492,178 A 2/1996 Nguyen et al.
5,501,274 A 3/1996 Nguyen et al.
5,501,275 A 3/1996 Card et al.
5,507,342 A 4/1996 Copeland et al.
5,515,920 A 5/1996 Luk et al.
5,518,996 A 5/1996 Maroy et al.
5,629,271 A 5/1997 Dobson et al.
5,713,416 A 2/1998 Chatterji et al.
5,741,758 A 4/1998 Pakulski
5,893,416 A 4/1999 Read
5,908,073 A 6/1999 Nguyen et al.
5,922,652 A 7/1999 Kowalski et al.
5,934,376 A 8/1999 Nguyen et al.
5,964,291 A 10/1999 Bourne et al.
5,979,557 A 11/1999 Card et al.
6,059,034 A 5/2000 Rickards et al.
6,114,410 A 9/2000 Betzold
6,156,805 A 12/2000 Smith et al.
6,172,011 B1 1/2001 Card et al.
6,209,643 B1 4/2001 Nguyen et al.
6,209,646 B1 4/2001 Reddy et al.
6,236,894 B1 5/2001 Stoisits et al.
6,239,183 B1 5/2001 Farmer et al.
6,258,859 B1 7/2001 Dahayanake et al.
6,279,656 B1 8/2001 Sinclair et al.
6,302,207 B1 10/2001 Nguyen et al.
6,326,335 B1 12/2001 Kowalski et al.
6,328,105 B1 12/2001 Betzold
6,330,916 B1 12/2001 Rickards et al.
6,364,020 B1 4/2002 Crawshaw et al.
6,379,865 B1 4/2002 Mao
6,380,136 B1 4/2002 Bates et al.
6,435,277 B1 8/2002 Qu et al.
6,439,309 B1 8/2002 Matherly et al.
6,446,722 B2 9/2002 Nguyen et al.
6,464,009 B2 10/2002 Bland et al.
6,482,517 B1 11/2002 Anderson
6,506,710 B1 1/2003 Hoey et al.
6,543,538 B2 4/2003 Tolman et al.
6,559,245 B2 5/2003 Mao et al.
6,599,863 B1 7/2003 Palmer et al.
6,644,844 B2 11/2003 Neal et al.
6,656,265 B1 12/2003 Garnier et al.
6,703,352 B2 3/2004 Dahayanake et al.
6,719,054 B2 4/2004 Cheng et al.
6,723,683 B2 4/2004 Crossman et al.
6,725,930 B2 4/2004 Boney et al.
6,742,590 B1 6/2004 Nguyen
6,776,235 B1 8/2004 England
6,818,594 B1 11/2004 Freeman et al.
6,828,280 B2 12/2004 England et al.
6,860,328 B2 3/2005 Gonzalez et al.
6,874,578 B1 4/2005 Garnier et al.
6,877,560 B2 4/2005 Nguyen et al.
6,938,693 B2 9/2005 Boney et al.
6,989,195 B2 1/2006 Anderson
7,004,255 B2 2/2006 Boney
7,028,775 B2 4/2006 Fu et al.
7,044,220 B2 5/2006 Nguyen et al.
7,044,224 B2 5/2006 Nguyen
7,049,272 B2 5/2006 Sinclair et al.
7,060,661 B2 6/2006 Dobson et al.
7,066,260 B2 6/2006 Sullivan et al.
7,148,185 B2 12/2006 Fu et al.
7,178,596 B2 2/2007 Blauch et al.
7,213,651 B2 5/2007 Brannon et al.
7,237,610 B1 7/2007 Saini et al.
7,257,596 B1 8/2007 Williams
7,261,157 B2 8/2007 Nguyen et al.
7,267,170 B2 9/2007 Mang et al.
7,275,596 B2 10/2007 Willberg et al.
7,284,611 B2 10/2007 Reddy et al.
7,290,615 B2 11/2007 Christanti et al.
7,294,347 B2 11/2007 Menjoge et al.
7,303,018 B2 12/2007 Cawiezel et al.
7,345,012 B2 3/2008 Chen et al.
7,373,991 B2 5/2008 Vaidya et al.
7,379,853 B2 5/2008 Middya
7,398,826 B2 7/2008 Hoefer et al.
7,405,183 B2 7/2008 Hanes, Jr.
7,419,937 B2 9/2008 Rimmer et al.
7,451,812 B2 11/2008 Cooper et al.
7,482,311 B2 1/2009 Willberg et al.
7,510,009 B2 3/2009 Cawiezel et al.
7,528,096 B2 5/2009 Brannon et al.
7,543,640 B2 6/2009 MacDougall
7,559,369 B2 7/2009 Roddy et al.
7,565,929 B2 7/2009 Bustos et al.
7,581,590 B2 9/2009 Lesko et al.
7,624,802 B2 12/2009 McCrary et al.
7,644,761 B1 1/2010 Gu et al.
7,703,531 B2 4/2010 Huang et al.
7,784,541 B2 8/2010 Hartman et al.
7,789,146 B2 9/2010 Panga et al.
7,806,182 B2 10/2010 Waters et al.
7,833,947 B1 11/2010 Kubala
7,836,949 B2 11/2010 Dykstra
7,841,394 B2 11/2010 McNeel et al.
7,923,415 B2 4/2011 Panga et al.
7,931,082 B2 4/2011 Surjaatmadja et al.
7,931,088 B2 4/2011 Stegemoeller et al.
7,946,340 B2 5/2011 Surjaatmadja et al.
7,954,548 B2 6/2011 Curimbaba et al.
7,973,991 B2 7/2011 Watanabe
8,008,234 B2 8/2011 Panga et al.
8,119,574 B2 2/2012 Panga et al.
8,167,043 B2 5/2012 Willberg et al.
8,168,570 B2 5/2012 Barron et al.
8,210,249 B2 7/2012 Panga et al.
8,322,410 B2 12/2012 Abad et al.
2003/0134751 A1 7/2003 Lee et al.
2004/0060702 A1 4/2004 Kotlar et al.
2004/0074646 A1 4/2004 Kotlar et al.
2004/0106525 A1 6/2004 Willberg et al.
2004/0152601 A1 8/2004 Still et al.
2004/0168811 A1 9/2004 Shaw et al.
2004/0209780 A1 10/2004 Harris et al.
2004/0261993 A1 12/2004 Nguyen
2004/0261995 A1 12/2004 Nguyen et al.
2004/0261996 A1 12/2004 Munoz, Jr. et al.
2005/0027499 A1 2/2005 Bourbiaux et al.
2005/0103496 A1 5/2005 Todd et al.
2005/0130845 A1 6/2005 Freeman et al.
2005/0130848 A1 6/2005 Todd et al.
2005/0161220 A1 7/2005 Todd et al.
2005/0166961 A1 8/2005 Means et al.

(56) References Cited

U.S. PATENT DOCUMENTS

| | | | |
|---|---|---|---|
| 2005/0172699 | A1 | 8/2005 | Hu et al. |
| 2005/0233895 | A1 | 10/2005 | Mertens et al. |
| 2005/0252651 | A1 | 11/2005 | Bosma et al. |
| 2005/0252659 | A1 | 11/2005 | Sullivan et al. |
| 2006/0006539 | A1 | 1/2006 | Matsui et al. |
| 2006/0048943 | A1 | 3/2006 | Parker et al. |
| 2006/0048944 | A1 | 3/2006 | Van Batenburg et al. |
| 2006/0052251 | A1 | 3/2006 | Anderson et al. |
| 2006/0054324 | A1 | 3/2006 | Sullivan et al. |
| 2006/0058197 | A1 | 3/2006 | Brown et al. |
| 2006/0073980 | A1 | 4/2006 | Brannon et al. |
| 2006/0113078 | A1 | 6/2006 | Nguyen et al. |
| 2006/0124302 | A1 | 6/2006 | Gupta et al. |
| 2006/0151173 | A1 | 7/2006 | Slabaugh et al. |
| 2006/0157243 | A1 | 7/2006 | Nguyen |
| 2006/0175059 | A1 | 8/2006 | Sinclair et al. |
| 2006/0185848 | A1 | 8/2006 | Surjaatmadja et al. |
| 2006/0289160 | A1 | 12/2006 | Van Batenburg et al. |
| 2007/0017675 | A1 | 1/2007 | Hammami et al. |
| 2007/0029086 | A1 | 2/2007 | East |
| 2007/0039733 | A1 | 2/2007 | Welton et al. |
| 2007/0042912 | A1 | 2/2007 | Welton et al. |
| 2007/0044963 | A1 | 3/2007 | MacDougall |
| 2007/0125543 | A1 | 6/2007 | McNeel et al. |
| 2007/0125544 | A1 | 6/2007 | Robinson et al. |
| 2007/0201305 | A1 | 8/2007 | Heilman et al. |
| 2007/0238623 | A1 | 10/2007 | Saini et al. |
| 2007/0289740 | A1 | 12/2007 | Thigpen et al. |
| 2008/0000391 | A1 | 1/2008 | Drochon |
| 2008/0000638 | A1 | 1/2008 | Burukhin et al. |
| 2008/0053657 | A1 | 3/2008 | Alary et al. |
| 2008/0066910 | A1 | 3/2008 | Alary et al. |
| 2008/0103065 | A1 | 5/2008 | Reddy et al. |
| 2008/0108520 | A1 | 5/2008 | Fu et al. |
| 2008/0121395 | A1 | 5/2008 | Reddy et al. |
| 2008/0135250 | A1 | 6/2008 | Bosma et al. |
| 2008/0162099 | A1 | 7/2008 | Vega |
| 2008/0210423 | A1 | 9/2008 | Boney |
| 2008/0236818 | A1 | 10/2008 | Dykstra |
| 2008/0280788 | A1 | 11/2008 | Parris et al. |
| 2008/0280790 | A1 | 11/2008 | Mirakyan et al. |
| 2008/0314594 | A1 | 12/2008 | Still et al. |
| 2008/0318026 | A1 | 12/2008 | Dai et al. |
| 2009/0008095 | A1 | 1/2009 | Duncum et al. |
| 2009/0025394 | A1 | 1/2009 | Bonzani et al. |
| 2009/0025934 | A1 | 1/2009 | Harman et al. |
| 2009/0095482 | A1 | 4/2009 | Surjaatmadja |
| 2009/0194273 | A1 | 8/2009 | Surjaatmadja et al. |
| 2009/0294126 | A1 | 12/2009 | Dalrymple et al. |
| 2010/0000735 | A1 | 1/2010 | Weaver et al. |
| 2010/0087341 | A1 | 4/2010 | Alary et al. |
| 2010/0087342 | A1 | 4/2010 | Alary et al. |
| 2010/0089580 | A1 | 4/2010 | Brannon et al. |
| 2010/0126722 | A1 | 5/2010 | Cornelissen et al. |
| 2010/0163225 | A1 | 7/2010 | Abad et al. |
| 2010/0200247 | A1 | 8/2010 | Dybevik et al. |
| 2010/0252259 | A1 | 10/2010 | Horton |
| 2010/0300688 | A1 | 12/2010 | Panga et al. |
| 2011/0005760 | A1 | 1/2011 | Hartman et al. |
| 2011/0028357 | A1 | 2/2011 | Abad et al. |
| 2011/0036577 | A1 | 2/2011 | Barmatov et al. |
| 2011/0053813 | A1 | 3/2011 | Panga et al. |
| 2011/0063942 | A1 | 3/2011 | Hagan et al. |
| 2011/0083849 | A1 | 4/2011 | Medvedev et al. |
| 2011/0098202 | A1 | 4/2011 | James et al. |
| 2011/0155371 | A1 | 6/2011 | Panga et al. |
| 2011/0198089 | A1 | 8/2011 | Panga et al. |
| 2011/0247812 | A1 | 10/2011 | Panga et al. |
| 2011/0312857 | A1 | 12/2011 | Amanullah et al. |
| 2012/0000641 | A1 | 1/2012 | Panga et al. |
| 2012/0000651 | A1 | 1/2012 | Panga et al. |
| 2012/0132421 | A1 | 5/2012 | Loiseau et al. |
| 2012/0138296 | A1 | 6/2012 | Panga et al. |
| 2012/0190598 | A1 | 7/2012 | McCubbins, Jr. et al. |
| 2012/0247764 | A1 | 10/2012 | Chen et al. |
| 2012/0247767 | A1 | 10/2012 | Themig et al. |
| 2012/0285694 | A1 | 11/2012 | Morvan et al. |
| 2012/0305254 | A1 | 12/2012 | Chen et al. |
| 2012/0318514 | A1* | 12/2012 | Mesher ..... 166/305.1 |
| 2013/0206415 | A1 | 8/2013 | Sheesley |
| 2013/0211807 | A1 | 8/2013 | Templeton-Barrett et al. |
| 2014/0060831 | A1* | 3/2014 | Miller ..... E21B 43/267 166/280.1 |
| 2014/0096974 | A1 | 4/2014 | Coli et al. |
| 2014/0131045 | A1* | 5/2014 | Loiseau ..... E21B 43/119 166/305.1 |
| 2014/0190691 | A1 | 7/2014 | Vinegar et al. |
| 2014/0278315 | A1 | 9/2014 | Kim et al. |
| 2015/0066463 | A1 | 3/2015 | Shetty et al. |
| 2015/0377005 | A1 | 12/2015 | Garcia-Teijeiro et al. |

FOREIGN PATENT DOCUMENTS

| | | | | |
|---|---|---|---|---|
| CN | 201358774 | Y | 12/2009 | |
| EP | 1236701 | A1 | 9/2002 | |
| GB | 2277543 | A | 11/1994 | |
| RU | 2065442 | C1 | 8/1996 | |
| RU | 2221130 | C1 | 1/2004 | |
| RU | 2376451 | C1 | 12/2009 | |
| RU | 2404359 | C2 | 11/2010 | |
| RU | 2413064 | C2 | 2/2011 | |
| RU | 2417243 | C2 | 4/2011 | |
| WO | 9607710 | A1 | 3/1996 | |
| WO | 9930249 | A1 | 6/1999 | |
| WO | 2004007904 | A1 | 1/2004 | |
| WO | 2004038176 | A1 | 5/2004 | |
| WO | 2006082359 | A1 | 8/2006 | |
| WO | 2009013710 | A2 | 1/2009 | |
| WO | 2009030020 | A1 | 3/2009 | |
| WO | 2009088317 | A1 | 7/2009 | |
| WO | 2009106796 | A1 | 9/2009 | |
| WO | 2009141749 | A2 | 11/2009 | |
| WO | 2010117547 | A1 | 10/2010 | |
| WO | 2011024100 | A2 | 3/2011 | |
| WO | 2011129937 | A2 | 10/2011 | |
| WO | 2011143055 | A1 | 11/2011 | |
| WO | 2012001574 | A2 | 1/2012 | |
| WO | WO 2013134624 | A1 * | 9/2013 | ..... E21B 43/26 |

OTHER PUBLICATIONS

Asgian et al., "Mechanical Stability of Porpped Hydraulic Fractures: A Numerical Study", SPE 28510—JPT, pp. 203-208, Mar. 1995.

Aveyard et al., "Emulsuions stabilized solely by colloidal particles", Advances in Colloid and Interface Science, pp. 503-546, 2003.

Binks et al., "Pickering Emulsions Stabilized by Monodisperse Latex Particles: Effects of Particle Size", Langmuir vol. 17, No. 15, pp. 4540-4547, 2001.

Cipolla et al., "Fracture Design Considerations in Horizontal Wells Drilled in Unconventional Gas Reservoirs", SPE 119366, 2009, 10 pages.

Constien et al., "Performance of Fracturing Materials", Economides M.J. and Nolte K.G. Reservoir Stimulation, John Wiley and Sons, Ltd. 3rd Edition, New York, Chapter 8, pp. 8-1-8-26, 2000.

Curry et al., "Less Sand May Not be Enough", SPE 131783; SPR Unconventional Gas Conference, Pittsburg, PA, USA, Jun. 2010, 14 pages.

De Pater et al., "Experiments and numerical simulation of hydraulic fracturing in naturally fractured rock", The 40th US Symposium of Rock Mechanics (USRMS) Anchorage, AK, USA—ARMA/USRMS 05-780, Jun. 2010, 12 pages.

Desroches et al., "On the Modeling of Near Tip Processes in Hydraulic Fractures", International Journal of Rock Mechanics and Mining Sciences & Geomechanics abstracts, vol. 30. No. 7, pp. 1127-1134, 1993.

Desroches et al., "The Crack Tip Region in Hydraulic Fracturing", Proc. Royal Society London A, vol. 447, pp. 39-48, 1994.

Elbel et al., "Fracture Treatment Design", Reservoir Stimulation, Economides M.J and Nolte K.G., John Wiley and Sons, Ltd. 3rd Edition New York, Chapter 10, pp. 10-1-10-50, 2000.

(56) References Cited

OTHER PUBLICATIONS

Gulbis et al., "Fracturing Fluid Chemistry and Proppants", Economides M.J. and Nolte K.G. Reservoir Stimulation, John Wiley and Sons, Ltd. 3rd Edition, New York, Chapter 7, pp. 7-1-7-23, 2000.
Kirk-Othmer, "Cyanamides", Encyclopedia of Chemical Technology, vol. 7, pp. 297-299, 1965.
Kirk-Othmer, "Petroleum (Drilling Fluids)", Encyclopedia of Chemical Technology, vol. 17, pp. 143-167, 1982.
Milton-Tayler et al., "Factors Affecting the Stability of Proppant in Propped Fractures: Results of a Laboratory Study", SPE 24821 presented at the SPE Annual Technical Conference and Exhibition, Washington D.C, Oct. 1992, 11 pages.
Montagne et al., "Highly magnetic latexes from submicrometer oil in water ferrofluid emulsions", Journal of polymer Science, Part A Polymer Chemistry vol. 44, No. 8, pp. 2642-2656, 2006.
Nolte, K.G., "Application of Fracture Design Based on Pressure Analysis", SPE13393—SPE Production Engineering vol. 3, No. 1, pp. 31-42, Feb. 1988.
Nolte et al., "Interpretation of Fracturing Pressures", SPE 8297—JPT, vol. 12, No. 8, pp. 1767-1775, Sep. 1981.
Park et al., "Rheological Properties and Stabilization of Magnetorheological Fluids in a Water-in-Oil Emulsion", Journal of Colloid and Interface Science, vol. 240, pp. 349-354, 2001.
Pickering, S.U., "Emulsions", Journal of the Chemical Society, vol. 91, pp. 2001-2021, 1907.
Schlumberger, CemCRETE Brochure, 2 pages, 2003.
Schlumberger, "Materials", Cementing Services and Products—Materials, pp. 39-76, 2012.
Smith et al., "Basics of Hydraulic Fracturing", Economides M.J. and Nolte K.G. Reservoir Stimulation, John Wiley and Sons, Ltd. 3rd Edition, New York, Chapter 5, pp. 5-1-5-28, 2000.
Smith et al., "Tip Screenout Fracturing: A Technique for Soft, Unstable Formations", SPE 13273—SPE Production Engineering, vol. 2, No. 2, pp. 95-103, May 1987.
First Office Action issued in related CN application 201380024407.1 dated Mar. 4, 2016, 12 pages.
Office Action issued in Chinese Patent Appl. No. 201380024203.8 dated Mar. 28, 2017; 23 pages (with English translation).
Examination Report issued in GCC Patent Application No. GC 2013-23772 dated Aug. 28, 2016; 5 pages.
Office Action issued in Chinese Patent Appl. No. 201380024203.8 dated Apr. 22, 2016; 19 pages (with English translation).
Examination Report issued in GCC Patent Application No. GC 2013-23772 dated Jan. 29, 2017; 4 pages.

* cited by examiner

SYSTEM AND METHOD FOR DELIVERING TREATMENT FLUID

RELATED APPLICATION DATA

None.

BACKGROUND

The statements in this section merely provide background information related to the present disclosure and may not constitute prior art.

In the recovery of hydrocarbons from subterranean formations, it is often necessary to apply various treatment procedures to the well to improve the life and/or the productivity of the well. Examples of the treatment procedures include, but are not limited to, cementing, gravel packing, hydraulic fracturing, and acidizing. Particularly, in formations with low permeability, it is common to fracture the hydrocarbon-bearing formation to provide flow channels. These flow channels facilitate movement of the hydrocarbons to the wellbore so that the hydrocarbons may be recovered from the well.

Fracturing has historically been an operation where the materials that were going to be pumped were prepared on location. Deliveries of liquids, proppant, and chemicals were all accomplished before the job began. Specialized storage equipment was normally used for handling the large quantities of materials, such as sand chiefs made by Besser. Similarly, specialized tanks such as water tanks and frac tanks were used for liquids. These tanks are typically the largest possible volume that can be legally transported down the road without a permit. Once everything was ready, more specialized equipment was used to prepare gel, mix in proppant, dose with chemicals, and deliver the resulting fluid to the fracturing pumps under positive pressure. All of these specialized well site vehicles and units are expensive, and lead to a very large footprint on location.

FIG. 1A illustrates a wellsite configuration 9 that is typically used in current land-based fracturing operations. The proppant is contained in sand trailers 10 and 11. Water tanks 12, 13, 14, 15, 16, 17, 18, 19, 20, 21, 22, 23, 24, and 25 are arranged along one side of the operation site. Hopper 30 receives sand from the sand trailers 10,11 and distributes it into the mixers 26, 28. Blenders 33, 36 are provided to blend the carrier medium (such as brine, viscosified fluids, etc.) with the proppant and then transferred to manifolds 31, 32. The final mixed and blended slurry, or frac fluid, is then transferred to the pump trucks 27, 29, and routed at high pressure through treating lines 34 to rig 35, and then pumped downhole.

Referencing to FIG. 1B, a conventional fracturing operation 100 is illustrated schematically. The operation 100 includes a water tank 102 and a polymer supplier 104. The water tank is any base fluid including, for example, brine. The operation 100 may include a precision continuous mixer 106. In certain embodiments, the precision continuous mixer 106 is replaced by an operation 100 where the polymer is fully mixed and hydrated in the water tank 102. It can be seen that, where the polymer is pre-batched, very little flexibility to the size of the fracturing operation is available. For example, if an early screen-out occurs, a large amount of fracturing fluid is wasted and must be disposed. The operation 100 further includes an operation 108 to slowly agitate and hydrate the fracturing fluid, which may occur within a residence vessel or within a properly sized precision continuous mixer 106. The operation 100 further includes a proppant 110 mixed with the hydrated fluid, for example at a high-speed blender 112 that provides the proppant laden slurry to fracturing pumps. The operation 100 further includes an operation 114 to pump the slurry downhole.

It can be seen from the operation 100 that various equipment is required at the location, including the water tanks, a chemical truck or other vehicle carrying the polymer and/or other additives, a continuous mixer, a proppant vehicle (sand truck, sand chief, etc.), a blender (e.g. a POD blender), and various fracturing pumps. Alternatively, the continuous mixer may be replaced with equipment and time to batch mix the fracturing fluid into the water tanks in advance, increasing the operational cost, reducing the flexibility of the fracturing treatment, and increasing the physical footprint of the fracturing operation. Also, a large amount of water is needed for a fracturing operation, which leads to the generation of a large amount of flowback fluid. The storage, management, and disposal of the flowback fluid are expensive and environmentally challenging.

The current application addresses one or more of the problems associated with the conventional fracturing operation.

SUMMARY

In certain embodiments, a method is disclosed which includes preparing a pump-ready fracturing fluid, delivering the pump-ready fracturing fluid to a location operationally coupled to a wellsite, and pumping the fracturing fluid downhole to fracture a subterranean formation. The pump-ready fracturing fluid may be a fluid that is directly provideable to a pump for high pressure delivery. The pump-ready fracturing fluid may be further conditioned, as additional additives, liquid, etc. may be added to the pump-ready fracturing fluid before or during a formation treatment operation. The method may further include providing the pump-ready fracturing fluid to a positive displacement pump inlet, and pumping the pump-ready fracturing fluid into a wellbore. The method may further include combining pump-ready fracturing fluid sources in a manifold, pressurizing the pump-ready fracturing fluid, and/or providing shear or residence time conditions upstream of the positive displacement pump inlet. In certain embodiments the method includes hydrating, shearing, or conditioning the pump-ready fracturing fluid before the providing the pump-ready fracturing fluid to the positive displacement pump inlet. In certain embodiments, the method includes recirculating a sump side of the positive displacement pump during the pumping. In certain embodiments, the method includes pumping an alternate fluid pill during the pumping, for example alternating to the fluid pill and then back to the pump-ready fracturing fluid.

In certain embodiments, a system is disclosed which includes a regional blending facility that prepares pump-ready treatment fluid for use at a wellsite. The regional blending facility may include bulk receiving facilities that receive and store a number of particle types, each of the number of particle types having a distinct size modality. The facility may include a batching vessel and a bulk moving device to transfer particle types between the bulk receiving facilities and the batching vessel. The facility may further include a mixer that receives batched material from the batching vessel and provides a mixed product fluid, a product storage that stores the mixed product, and a transportation device that delivers the prepared fluid to a wellsite for usage.

In certain embodiments, the bulk receiving facilities may include a mobile receiver that positions under a bulk material carrier, a below grade receiver that allows a bulk material carrier to be positioned thereabove, a depressurized receiver that pneumatically receives bulk material, and/or a receiving area that receives and stores a bulk material carrier in the entirety. In certain embodiments, the bulk moving device may include a pneumatic system utilizing heated air and/or a mechanical bulk transfer device. In certain embodiments, the batching vessel includes a portion of a batching device, wherein the batching device includes an accumulative batch measurement device, a decumulative batch measurement device, and/or an intermediary vessel sized to be larger than a batch size, where the batching device includes structures for accumulating an amount larger than the batch size in the intermediary vessel, and decumulating the batch size from the intermediary vessel. An example batching device may additionally or alternatively include a number of batch vessels each receiving one of a plurality of distinct product modalities, or each receiving a distinct mix of product modalities.

An example mixing device includes a feed screw operationally coupling the batching vessel to the product storage, a feed screw operationally coupling the batching vessel to the product storage, the feed screw including a mixing feature, and/or a feed screw operationally coupling the batching vessel to the product storage. The feed screw may include a mixing feature, wherein the mixing feature comprises at least one of a tab, a slot, and a hole. Additionally or alternatively, the mixing device may include a drum mixer, a ribbon blender, a twin shaft compulsory mixer, a planetary mixer, a pug mill, a blender (e.g. a POD blender), and/or a colloidal mixer.

In certain embodiments, the product storage may include tanks having a portion with a reduced cross-sectional area, a vessel positioned to gravity feed the wellsite transportation device, a vessel having a head tank, a pressurizable storage vessel, and/or an agitation device. In certain embodiments, the wellsite transportation device is sized in response to a density of the mixed treatment fluid. An example wellsite transportation device may be deployable as a vertical silo, a trailer having an elevated portion, a plurality of trailers having coupled portions, and/or an unfolding trailer.

In certain embodiments, a method is disclosed for preparing a pump-ready fluid. An example method includes providing a carrier fluid fraction, providing an immiscible substance fraction including a plurality of particles such that a packed volume fraction (PVF) of the particles exceeds 64%, mixing the carrier fluid fraction and the immiscible substance fraction into a treatment slurry, and providing the treatment slurry to a storage vessel. The immiscible substance fraction exceeds 59% by volume of the treatment slurry. The method may further include positioning the storage vessel at a wellsite, and/or positioning the storage vessel vertically, for example where the storage vessel is a vertical silo. The method may further include fluidly coupling the storage vessel to a pump intake, and treating a wellbore with the treatment slurry. In certain embodiments, the method further includes providing all of a proppant amount for the treating of the wellbore within the treatment slurry. The example method in certain embodiments includes transferring the treatment slurry to a transportation device.

In certain further embodiments, the method includes performing the operations of: providing the carrier fluid fraction, providing the immiscible substance fraction, and mixing the carrier fluid fraction, at a facility remote from a wellsite. The facility includes a powered device to perform at least one of the providing and mixing operations, and the example method further includes capturing a carbon dioxide emission of the powered device. An example capturing operation includes capturing the carbon dioxide emission by injecting the carbon dioxide into a disposal well operationally coupled to the facility. In certain embodiments, the method further includes capturing and disposing of a treatment fluid byproduct at the facility remote from the wellsite. In certain further embodiments, the method includes selecting a location for the facility remote from the wellsite by selecting a location having an enhanced environmental profile relative to an environmental profile of the wellsite, where the wellsite is an intended treatment target for the treatment slurry.

BRIEF DESCRIPTION OF THE DRAWINGS

These and other features and advantages will be better understood by reference to the following detailed description when considered in conjunction with the accompanying drawings.

DETAILED DESCRIPTION OF SOME ILLUSTRATIVE EMBODIMENTS

Figure 1A:
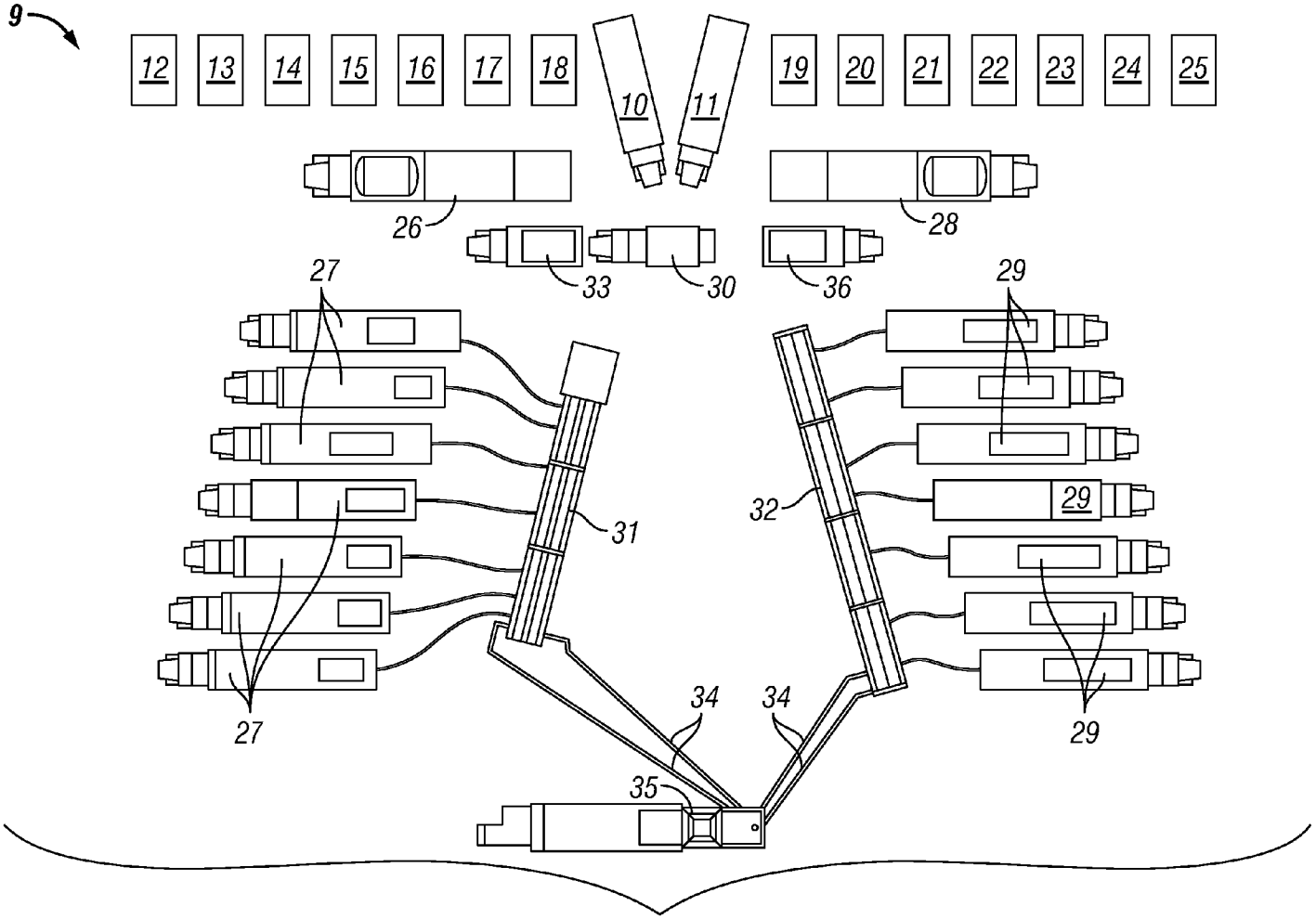
FIG. 1A (Prior Art)
FIG. 1A is a schematic representation of the equipment configuration of a conventional fracturing operation.
Figure 1B:
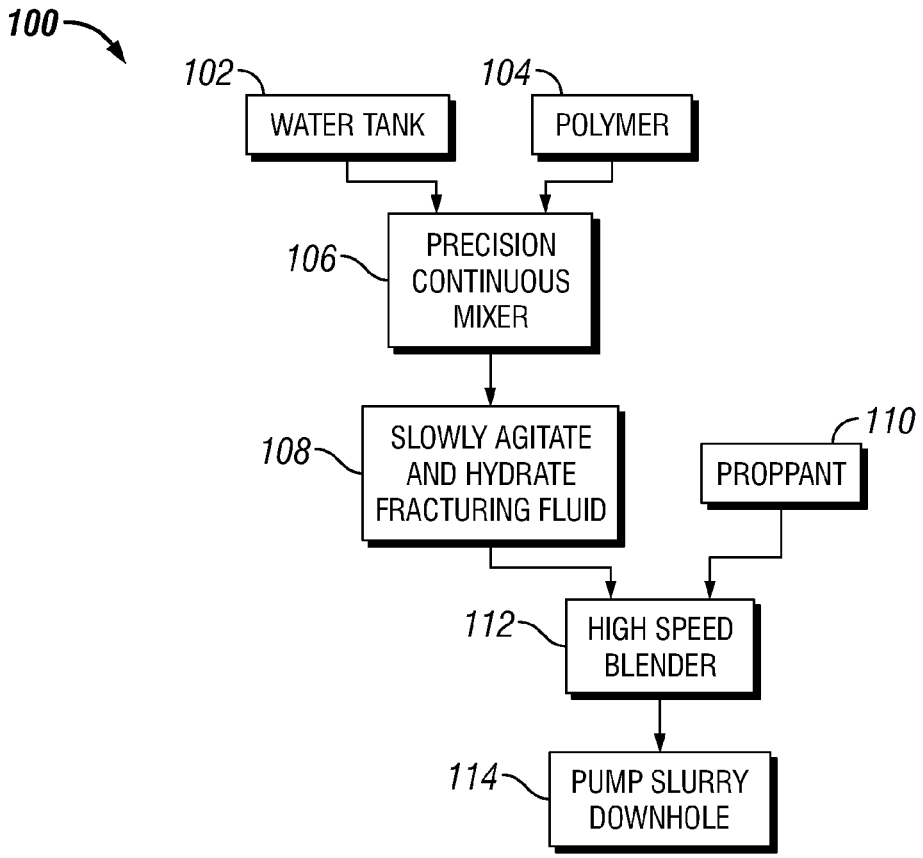
FIG. 1B (Prior Art)
FIG. 1B is a schematic representation of a conventional fracturing operation.

For the purposes of promoting an understanding of the principles of the disclosure, reference will now be made to the embodiments illustrated in the drawings and specific language will be used to describe the same. It will nevertheless be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

The schematic flow descriptions which follow provide illustrative embodiments of performing procedures for preparing and delivering treatment fluid or treatment fluid precursor to a wellsite. Operations illustrated are understood to be examples only, and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

In particular, it should be understood that, although a substantial portion of the following detailed description is provided in the context of oilfield hydraulic fracturing operations, other oilfield operations such as cementing, gravel packing, etc. can utilize and benefit from the disclosure of the current application as well. All variations that can be readily perceived by people skilled in the art after reviewing the current application should be considered as within the scope of the current application.

As used herein, the term "treatment fluid" should be understood broadly. Treatment fluids include liquid, a solid, a gas, and combinations thereof, as will be appreciated by those skilled in the art. A treatment fluid may take the form of a solution, an emulsion, a slurry, or any other form as will be appreciated by those skilled in the art. In some embodiments, the treatment fluid may contain a carrying medium and a substance that is substantially immiscible therein. The carrying medium may be any matter that is substantially continuous under a given condition. Examples of the carrying medium include, but are not limited to, water, hydrocarbon, gas, liquefied gas, etc. In some embodiments, the carrying medium may optionally include a viscosifying agent. Some non-limiting examples of the carrying medium include hydratable gels (e.g. guars, poly-saccharides, xanthan, diutan, hydroxy-ethyl-cellulose, etc.), a cross-linked hydratable gel, a viscosified acid (e.g. gel-based), an emulsified acid (e.g. oil outer phase), an energized fluid (e.g. an N2 or CO2 based foam), a viscoelastic surfactant (VES) viscosified fluid, and an oil-based fluid including a gelled, foamed, or otherwise viscosified oil. Additionally, the carrier medium may be a brine, and/or may include a brine. The substantially immiscible substance can be any matter that only dissolves or otherwise becomes a constituent portion of the carrying fluid under a given condition for less than 10%, sometimes less than 20%, of the weight of substance when it is not in contact of the carrying medium. Examples of substantially immiscible substance include, but are not limited to, proppant, salt, emulsified hydrocarbon droplets, etc.

As used herein, the term "pump-ready" should be understood broadly. In certain embodiments, a pump-ready treatment fluid means the treatment fluid is fully prepared and can be pumped downhole without being further processed. In some other embodiments, the pump-ready treatment fluid means the fluid is substantially ready to be pumped downhole except that a further dilution may be needed before pumping or one or more minor additives need to be added before the fluid is pumped downhole. In such an event, the pump-ready treatment fluid may also be called a pump-ready treatment fluid precursor. In some further embodiments, the pump-ready treatment fluid may be a fluid that is substantially ready to be pumped downhole except that certain incidental procedures are applied to the treatment fluid before pumping, such as low-speed agitation, heating or cooling under exceptionally cold or hot climate, etc.

In certain embodiments, the pump-ready treatment fluid is a high particle content fluid where the volume fraction of the carrying medium in the pump-ready treatment fluid is less than 60% of the total volume of the pump-ready treatment fluid. Stated in another way, in such embodiments, the volume fraction of the immiscible substance in the pump-ready treatment fluid is equal to or more than 40% of the total volume of the pump-ready treatment fluid. In certain other embodiments, the volume fraction of the carrying medium is less than 50% of the pump-ready treatment fluid, with the immiscible substance making up 50% or more volume fraction of the pump-ready treatment fluid. In certain additional embodiments, the pump-ready treatment fluid has a volume fraction of the carrying medium that is less than 40% and a volume fraction of the immiscible substance that is 60% or more. In certain further embodiments, the pump-ready treatment fluid has a volume fraction of the carrying medium that is less than 30% and a volume fraction of the immiscible substance that is 70% or more. In certain even further embodiments, the pump-ready treatment fluid has a volume fraction of the carrying medium that is less than 20% and a volume fraction of the immiscible substance that is 80% or more. In certain additionally further embodiments, the pump-ready treatment fluid has a volume fraction of the carrying medium that is less than 10% and a volume fraction of the immiscible substance that is 90% or more.

In some cases, the immiscible substance contains a single particle size or particle size distribution (i.e. monomode). In some other cases, the immiscible substance contains a plurality of particles having distinct sizes or particles size distributions (i.e. multi-modes). As used herein, the terms distinct particle sizes, distinct particle size distribution, or multi-modes or multimodal, mean that each of the plurality of particles has a unique volume-averaged particle size distribution (PSD) mode. That is, statistically, the particle size distributions of different particles appear as distinct peaks (or "modes") in a continuous probability distribution function. For example, a mixture of two particles having normal distribution of particle sizes with similar variability is considered a bimodal particle mixture if their respective means differ by more than the sum of their respective standard deviations, and/or if their respective means differ by a statistically significant amount. In certain embodiments, the immiscible substance contains a bimodal mixture of two particles; in certain other embodiments, the immiscible substance contains a trimodal mixture of three particles; in certain additional embodiments, the immiscible substance contains a tetramodal mixture of four particles; in certain further embodiments, the immiscible substance contains a pentamodal mixture of five particles.

In some embodiments, the immiscible substance has a packed volume fraction (PVF) of 64% or higher. As used herein, the term "packed volume fraction, or PVF, means a theoretical calculation of the most likely configuration of particles of various sizes. It can be defined as the volume occupied by the particles divided by the total volume of the particles plus the void space between the particles. In certain other embodiments, the immiscible substance has a packed volume fraction (PVF) of 74% or higher. In certain additional embodiments, the immiscible substance has a packed volume fraction (PVF) of 87% or higher.

As used herein, the terms "particle" or "particulate" should be construed broadly. In certain embodiments, the particle or particulate is substantially spherical. In some certain embodiments, the particle or particulate is not substantially spherical. For example, the particle or particulate may have an aspect ratio, defined as the ratio of the longest dimension of the particle to the shortest dimension of the particle, of more than 2, 3, 4, 5 or 6. Examples of such non-spherical particles include, but are not limited to, fibers, flakes, discs, rods, stars, etc. Similarly, in some embodiments, the particle(s) or particulate(s) of the current application are solid such as proppant, sands, ceramics, crystals, salts, etc.; however, in some other embodiments, the particle(s) or particulate(s) can be liquid, gas, foams, emulsified droplets, etc. Moreover, in some embodiments, the particle(s) or particulate(s) of the current application are substantially stable and do not change shape or form over an extended period of time, temperature, or pressure; in some other embodiments, the particle(s) or particulate(s) of the current application are degradable, dissolvable, deformable, meltable, sublimeable, or otherwise capable of being changed in shape, state, or structure. All such variations should be considered within the scope of the current application.

Certain examples of treatment fluids, carrying media, and particles that can be used in the current application are illustrated in U.S. Pat. No. 7,784,541, US2011/0005760, US2010/0300688, U.S. Pat. No. 7,923,415, US2012/0000651, US2012/0000641, US2011/0155371, the entire contents of which are incorporated into the current application in the entireties.

In certain embodiments, the pump-ready treatment fluid is a fracturing fluid. In certain embodiments, the pump-ready fracturing fluid includes all ingredients, including proppant, for the fracturing treatment in a form that is directly deliverable to the suction side of a fracturing pump. The procedure may further include an operation to deliver the pump-ready fracturing fluid to a location operationally coupled to a wellsite, and an operation to provide the pump-ready fracturing fluid directly to a pump inlet. The procedure may further include an operation to pump the pump-ready fracturing fluid into a wellbore to initiate or propagate a fracture in the subterranean formation.

The term "proppant", as used herein, refers to particulates that are used in well work-overs and treatments, such as hydraulic fracturing operations, to hold fractures open following the treatment. The proppant can be naturally occurring materials, such as sand grains. It may also include man-made or specially engineered proppants, such as resin-coated sand or high-strength ceramic materials like sintered bauxite. In some embodiments, the proppant of the current application has a density greater than 2.45 g/cc, such as sand, ceramic, sintered bauxite or resin coated proppant. In some embodiments, the proppant of the current application has a density less than or equal to 2.45 g/cc, such as less than about 1.60 g/cc, less than about 1.50 g/cc, less than about 1.40 g/cc, less than about 1.30 g/cc, less than about 1.20 g/cc, less than 1.10 g/cc, or less than 1.00 g/cc. In some embodiments, the proppant concentration in the treatment fluid is about 6 pound-per-gallon (PPA). In some embodiments, the proppant concentration in the treatment fluid is about 12 pound-per-gallon (PPA). In some embodiments, the proppant concentration in the treatment fluid is about 16 pound-per-gallon (PPA). In some embodiments, the proppant concentration in the treatment fluid is about 20 pound-per-gallon (PPA). In some embodiments, the proppant concentration in the treatment fluid is about 24 pound-per-gallon (PPA). In some embodiments, the proppant concentration in the treatment fluid is about 30 pound-per-gallon (PPA). In some embodiments, the proppant concentration in the treatment fluid is about 36 pound-per-gallon (PPA). In some embodiments, the proppant concentration in the treatment fluid is about 40 pound-per-gallon (PPA).

In some embodiments, the oilfield treatment fluid of the current application is substantially stable over a period of time so that it can be transported or otherwise delivered to a wellsite without significant change in one or more properties of the fluid, such as viscosity, density, etc. In certain embodiment, the treatment fluids of the current application are substantially stable for about 8 hours. In certain embodiments, the treatment fluid of the current application is substantially stable for at least 24 hours. In some further embodiments, the treatment fluid of the current application is substantially stable for at least 72 hours. As used herein, the term "substantially stable" in the context of oilfield operations means that the oilfield fluid is in a stable condition after preparation and can be readily applied to a subterranean formation to perform a desired oilfield operation. In some embodiments, the term "substantially stable" refers to a condition that the viscosity of the oilfield fluid does not change for more than 20% over a prolonged period of time.

Figure 2:
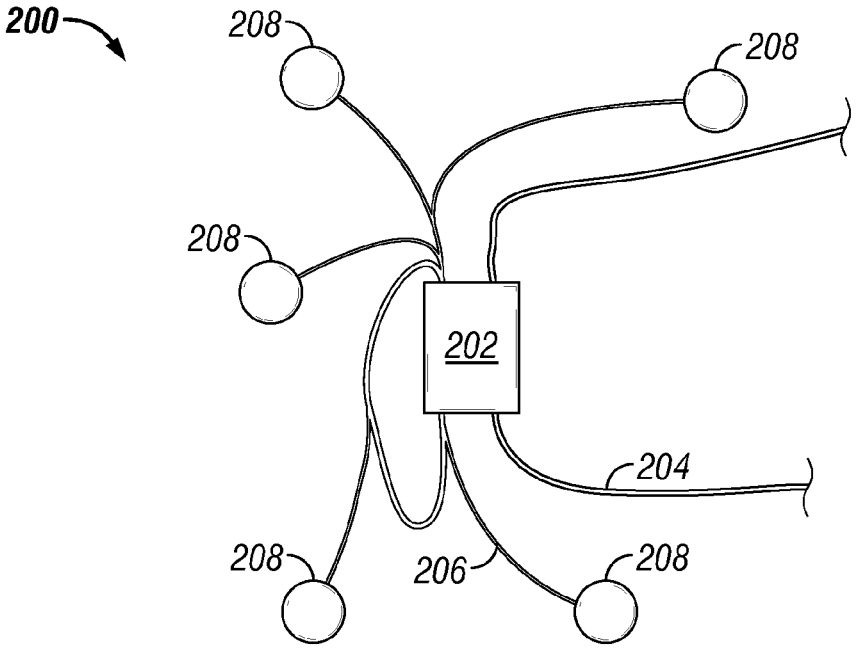
FIG. 2 is a of schematic representation of a treatment fluid preparation system according to some embodiments of the current application.

Referencing now to FIG. 2, a regional blending facility 202 is depicted according to some embodiments of the current application. The facility 202 may include a loading access 204 and an off-loading access 206. The loading access 204 may be a road, a rail, canal, pipeline, or any other transportation access wherein bulk product is deliverable to the facility 202. The off-loading access 206 may include any transportation access suitable for a transportation device (such as a vehicle, pipeline, etc.) to access one or more wellsites 208 and delivers a treatment fluid and/or treatment fluid pre-cursor loaded at the facility 202 to the wellsites 208. The type of transportation access for each of the loading access 204 and off-loading access 206 should be understood broadly and may include any type of road access, rail access, barge or boat access, tracked vehicle access, pipelines, etc. In certain embodiments, the loading access 204 and off-loading access 206 include the same transportation access, and/or are located on the same side of the facility 202. The exemplary facility 202 in FIG. 2 illustrates the loading access 204 and off-loading access 206 as separate transportation access separately and on opposite sides as one example, and to provide for clear illustration.

Example bulk material deliveries may include materials mined and processed on site (or nearby), trucked materials, or rail car materials. The loading and off-loading of mined or processed on site materials can be accomplished, in certain embodiments, using conventional techniques. Trucked and rail car delivered materials may be unloaded by using dumping or pneumatic conveying. Dumped materials may be collected and transferred into storage using screws, conveyor belts, air eductors, or valves into pressure pots for dense phase air transfer. In certain embodiments, equipment can be provided that either slides under the carrier or is built underground so that the carrier can move on top of the equipment. Pneumatic transfer is generally flexible in design and requires less site modification. Fine powders may be moved at relatively high transfer rates. The movement of sand is related to the pressure rating of the delivering vehicle and the size and length of the delivery hoses. In certain embodiments, a receiving vessel is equipped with a vacuum system to lower the vessel pressure, which may increase the differential pressure between the carrier and the receiving vessel, allowing higher flow rates without increasing the rating of the carrier.

The facility 202 can be positioned at a distance from a group of wellsites 108, sometimes more than 250 miles away, sometimes more than 100 miles away, and sometimes more than 50 miles away. Such a regional facility 202 may enhance logistical delivery of bulk material to a plurality of wellsites. In some other embodiments, the facility 202 may be positioned in a field among wellsites as indicated. Other example facilities 202 may be positioned near a single wellsite—for example on or near a remote location such as an offshore platform, on or near a pad for access to multiple wells from a single surface location, etc., which will be discussed in more details below. Additionally or alternatively, an example facility 202 can be positioned incrementally closer to one or more wellsites 208 than a base facility (or facilities) for treating equipment utilized to treat wells at the wellsite(s) 208. Yet another example facility 202 is positioned to reduce a total trip distance of equipment utilized to treat a number of wellsites relative to treating the wellsites from the base facility (facilities) of the various treating equipment. Yet another example facility 202 is positioned to reduce a total trip distance of equipment utilized to treat a number of wellsites, where the wellsites are distributed in more than one continuous field of wellsite locations.

Bulk material as utilized herein includes any material utilized in large quantities in a treatment fluid for a formation in a wellbore. The amount of material to be a large quantity is context specific. An example large quantity includes any amount of a specific material that is a sufficient amount of the specific material to produce an amount of a treatment fluid that exceeds the transport capacity of a transportation vehicle that delivers treatment fluid to a wellsite 208. In one example, if a sand truck to deliver proppant to a wellsite holds 38,000 pounds of proppant, an amount of proppant exceeding 38,000 pounds is a large quantity. Example an non-limiting bulk materials include: proppant, particles for a treatment fluid, particles for a treatment fluid having a specified size modality, gelling agents, breaking agents, surfactants, treatment fluid additives, base fluid for a treatment fluid (e.g. water, diesel fuel, crude oil, etc.), materials utilized to create a base fluid for a treatment fluid (e.g. KCl, NaCl, KBr, etc.), and acids of any type.

Figure 3:
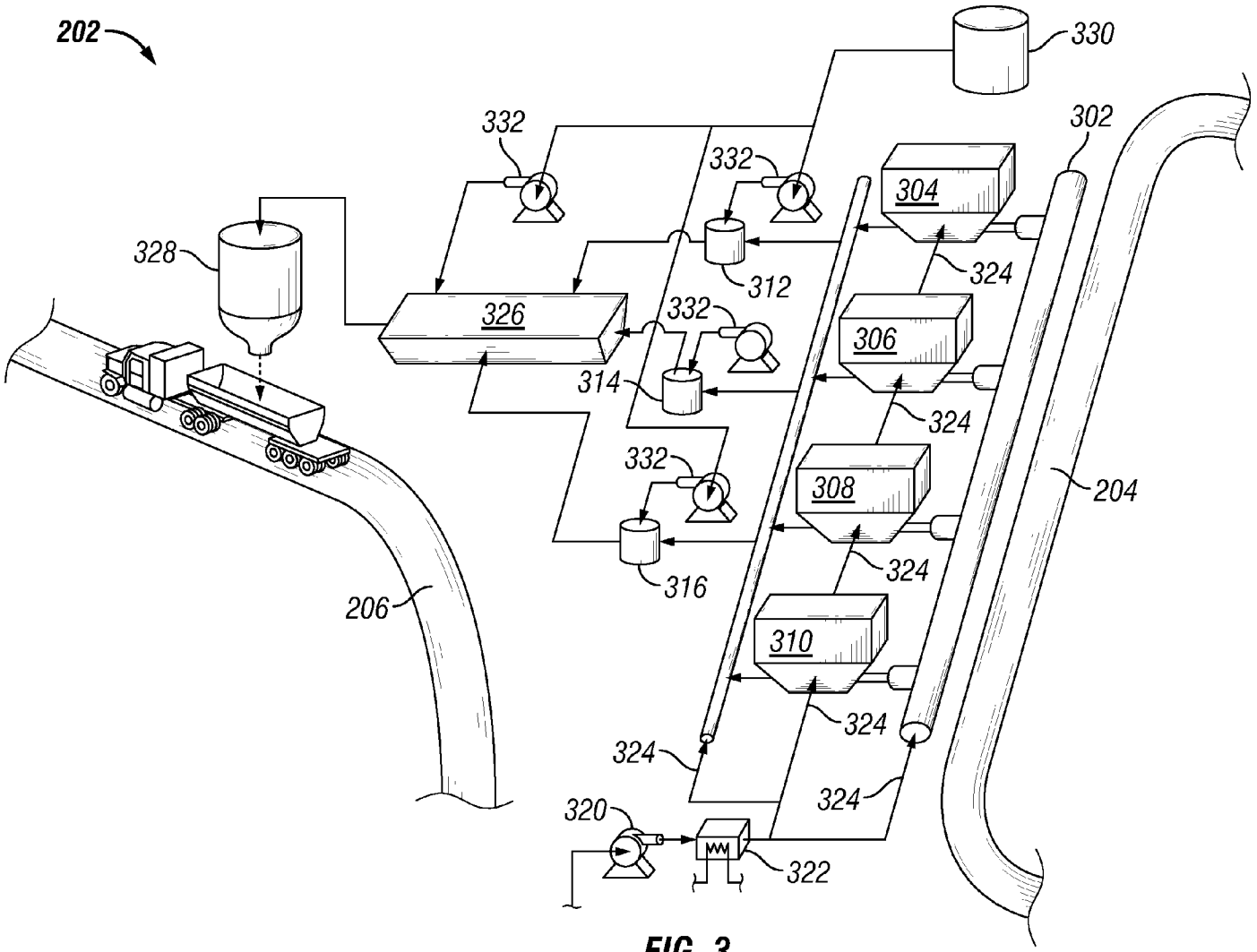
FIG. 3 is a schematic representation of a treatment fluid preparation facility according to some embodiments of the current application.

Referencing to FIG. 3, an example facility 202 is depicted schematically. The example facility 302 includes bulk receiving facilities 302 that receive and store a number of particle types. In one example, the bulk receiving facilities 302 receive bulk product from a delivering transport at the loading access 204, and deliver the bulk product to bulk storage vessels 304, 306, 308, 310. The example facility 202 includes the bulk receiving facilities 302 each storing one of a number of particles. In some embodiments, each bulk receiving facility 302 stores a particle with a distinct characteristic from other particles. In some embodiments, a plurality of bulk receiving facilities 302 stores particles with overlapping characteristics. The term particle characteristics should be construed broadly. In some embodiments, it is referred to particle size modality. In some embodiments, the term particle characteristics means particle shape, particle density, or particle hardness. In some embodiments, the term particle characteristics means particle surface charge, particle wettability, particle agglomeration profile, particle mineralogy profile, particle composition features such as single component particles or composite particles, particle with surface functionality groups, particle reactivity (such as inert vs. reactive particles), or particle chemical features (such as organic vs. inorganic particles). In some embodiments, the term particle characteristics means the combinations of one or more features described above. Specifically, in some embodiments, the term particle characteristics refers to particle size modalities. Therefore, particles having distinct particle characteristics can be interpreted to mean particles having distinct size values, such as different average particle sizes, different particle size ranges, and/or different particle size maximum and/or minimum values. particle sizes, particle size distributions, and so on.

In certain embodiments, the bulk receiving facilities 302 receive and deliver chemical or fluid additives to various storage areas of the facility 202. The bulk receiving facilities 302 may be a single device, a number of devices, and/or a number of distributed devices around the facility 202.

The bulk receiving facility 302 may further include a mobile receiver that is capable of being positioned under a bulk material carrier (not shown) that is positioned on the loading access 204. For example, a truck or rail car carrying particles may stop on the loading access 204 in proximity to the bulk receiving facility 302, and the bulk receiving facility 302 includes a receiving arm or funnel that can be rolled out, slid out, swiveled out, or otherwise positioned under the bulk material carrier. Any type of bulk material and receiving device that is positionable under the bulk material carrier is contemplated herein.

In some embodiments, the bulk receiving facility 302 may further include a below grade receiver that allows a bulk material carrier to be positioned thereabove. In one example, the loading access 204 includes a road having a hatch, covered hole, grate, or any other device allowing bulk material released from the bulk material carrier to pass therethrough and be received by the bulk receiving facility 302. The loading access 204, in certain embodiments, includes a raised portion to facilitate the bulk receiving facility 302 having a receiver below the grade of the loading access 204.

In certain embodiments, the bulk receiving facility 302 may include a pneumatic delivery system for pneumatically receiving bulk material. The illustrated facility 202 includes a pump 320 and pneumatic lines 324 structured in a single system connecting the bulk receiving facility 302 and the bulk storage vessels 304, 306, 308, 310. The configuration of the pneumatic delivery system may be any system understood in the art, including individual units for each vessel, grouped or sub-grouped units, etc. An example bulk receiving facility 302 is structured to de-pressurize during delivery from the bulk material carrier, and/or the pneumatic delivery system depressurizes the corresponding bulk storage vessel 304, 306, 308, 310 during delivery from the bulk material carrier. The facility 202 may include pneumatic equipment (not shown) to pressurize the bulk material carrier.

In certain embodiments, the bulk receiving facility 302 may include a receiving area (not shown) to receive and store a bulk material carrier in the entirety. For example, an example loading access 204 may include a rail, and the bulk receiving facility 302 may include a siding that allows a bulk material carrier to be received in the entirety and be utilized directly as one or more of the bulk storage vessels 304, 306, 308, 310 at the facility 202. The bulk receiving facility 302 may be structured to receive any type of bulk material carrier in the entirety to be utilized as one or more of the bulk storage vessels 304, 306, 308, 310. In certain embodiments, a portion of the bulk material carrier may be received directly to act as one or more of the bulk storage vessels 304, 306, 308, 310.

In some embodiments, the facility 202 may include one or more batching vessels 312, 314, 316. The batching vessels 312, 314, 316, where present, provide for intermediate components of a final product fluid to be prepared in the proper proportions. One or more particle types from the bulk storage vessels 304, 306, 308, 310 are delivered in the selected proportions to the batching vessels 312, 314, 316. The bulk delivery may be pneumatic, for example through the pneumatic lines 324 and/or through a separate pneumatic system 324. In some embodiments of the bulk storage vessels 304, 306, 308, 310, these vessels may be provided with more than one discharge port. Such ports may be spaced such that the angle of repose of the bulk material in question allows it to be fully emptied from the bulk vessel. Further, more than one bulk inlet may be similarly provided to allow the bulk material to substantially fill the bulk storage vessel, unhindered by the angle of repose of the material. In further reference to bulk storage vessels with multiple discharge ports, control systems may be provided that select different discharge ports for various periods of time to allow the bulk vessel to be unloaded despite the angle of repose preventing the entire vessel from being unloaded from one discharge port. Such systems may further incorporate sensing means to detect that one discharge port has reached its limit of discharge due to the angle of repose of the bulk material and thus change to a different discharge port. In certain embodiments, the pneumatic system may include a heater 322 that heats the air in the pneumatic lines 324, especially with respect to bulk materials that are not sensitive to temperature variations, such as proppant. The heater 222 can be particularly beneficial for operations under freezing point, where the addition of bulk solids into carrying medium may cause the carrying medium to freeze.

In some embodiments, the delivery from the bulk storage vessels 304, 306, 308, 310 to the batching vessels 312, 314, 316 includes a mechanical delivery device. For example, the bulk storage vessels 304, 306, 308, 310 may include a portion having a reduced cross-sectional area (e.g. cone bottomed vessels). A screw feeder, airlock, rotary valve, tubular drag conveyor, or other mechanical device may also be used to transfer the bulk material from the bulk storage vessels 304, 306, 308, 310 to the batching vessels 312, 314, 316. Each of the batching vessels 312, 314, 316 can be coupleable to one or more of the bulk storage vessels 304, 306, 308, 310, for example by various valves (not shown). Conversely, each of the bulk storage vessels 304, 306, 308, 310 can be coupled to one or more of the batching vessels 312, 314, 316, for example by various valves (not shown).

Dependent upon the types of treatment fluids produced, one or more of the batching vessels 312, 314, 316 may be dedicated to or limited to delivery from one or more of the bulk storage vessels 304, 306, 308, 310. In one non-limiting example, a first batching vessel 312 receives particles from the first bulk storage vessel 304, a second batching vessel 314 receive particles from the second bulk storage vessel 306, and a third batching vessel 316 selectively receives particles from the third and/or fourth bulk storage vessels 308, 310. In FIG. 3, the number of bulk storage vessels 304, 306, 308, 310 and batching vessels 312, 314, 316 depicted is illustrative and non-limiting. The example arrangements described and depicted are provided as illustrations to depict the flexibility of the facility 202, but any arrangement of bulk storage vessels 304, 306, 308, 310 and batching vessels 312, 314, 316 is contemplated herein.

In some embodiments, the facility 202 may further include a fluid vessel 330 and fluid pumps 332. The fluid vessel 330 and fluid pumps 332 may contain any type of carrying medium, chemical(s), and/or additive(s) for a given treatment fluid. FIG. 3 shows only a single fluid vessel 330 and circuit that are coupled to various batching vessels 312, 314, 316 and a mixing device 326 (see below), but it should be understood that any number of fluid vessels 330 and circuits may be present. Fluid additions to various vessels and streams in the facility 202 may be provided as desired and depending upon the fluid formulation of the product fluid.

In some embodiments, the facility 202 may further include a mixing device 326 that receives material from one or more of the batching vessels 312, 314, 316 and provides a mixed product fluid to a product storage vessel 328. The mixing device 326 may be any mixing device understood in the art that is compatible with the components of the treating fluid and that provides sufficient mixing. Example and non-limiting mixing devices 326 include a feed screw and a feed screw having mixing feature that provides additional fluid motion beyond axial fluid motion along the feed screw. An example feed screw with a mixing feature may include a tab, a slot, and/or a hole in one or more threads of the feed screw. Other example and non-limiting mixing devices 326 include a drum mixer, a ribbon blender, a planetary mixer, a pug mill, a blender, a controlled solids ratio blender (e.g. a POD blender), and/or a colloidal mixer. Another example mixing device 326 is a twin shaft compulsory mixer.

The mixer 326, as well as related controls and/or connected hardware to the mixer 326, provides in certain embodiments for receiving batched products according to a mixing schedule. The mixing schedule may include a schedule in time, spatial, and/or sequential mixing descriptions. For example, and without limitation, the product provided from each of the batching vessels 312, 314, 316 and/or fluid vessel 330 may be varied over time, the product provided from each of the batching vessels 312, 314, 316 and/or fluid vessel 330 may be provided to the mixing device 326 at distinct spatial positions (e.g. as shown in FIG. 3), and/or the product provided from each of the batching vessels 312, 314, 316 and/or the fluid vessel 330 may be provided according to a desired sequence.

In certain embodiments, the mixing device 326 and/or associated equipment conditions a powder (e.g. with an air pad, vibrator, heater, cooler, etc.) received at the mixing device 326. In certain embodiments, the mixing device 326 and/or associated equipment provides for a component dispersal. An example component dispersal includes pre-blending some or all of the component into one of the batching vessels 312, 314, 316 (e.g. to provide hydration time), pre-blending with an educator system, utilizing a paddle blender, injection through a pump or orifice, and/or injection into a centrifugal pump eye. In certain embodiments, the mixing device 326 and/or associated equipment provides for fluid conditioning, for example providing a desired fluid shear trajectory (high, low, and/or scheduled), de-lumping, straining, colloidal mixing, and/or shaking the fluid. In certain embodiments, the mixing device 326 and/or associated equipment provides for particle conditioning, for example providing sufficient fluid shear to break a larger particle size into a smaller desired particle size, and/or providing sufficient fluid shear to break or prevent clumping (e.g. between silica and calcium carbonate).

In certain embodiments, the sequencing of the addition of materials from the batching vessels 312, 314, 316, the spatial positions of the addition of materials, and/or the timing of the addition of materials, are selected to manage, minimize, or otherwise respond to compatibility issue and/or efficiency of mixing. For example, additions may be scheduled to minimize a contact time between incompatible components, and/or to add a material that minimizes incompatibility effects between two materials before one or both of the materials are added. In certain embodiments, the sequencing of the addition of materials from the batching vessels 312, 314, 316, the spatial positions of the addition of materials, and/or the timing of the addition of materials, are selected to account for physical deliverability characteristics of the components to be mixed. For example, a largest component may be added at a slow feed rate to the mixing device 326 at a position sweeping the entire device. A non-limiting example includes adding a largest component, adding all of a smallest component during the addition of the largest component, adding a medium component, and then finishing with the remainder of the largest component. A still further non-limiting example includes sequentially adding larger components and finishing with the addition of the largest component.

In certain embodiments, the mixing device 326 delivers the mixed product to a storage vessel 328. In certain embodiments, the mixing device 326 delivers the mixed product fluid directly to a transportation vehicle (not shown) which then transports the mixed product to a wellsite 208. In one example, the product storage vessel 328 is positioned to gravity feed a transportation vehicle. In some other examples, the product storage vessel 328 is positioned direction above the off-loading access 206, which in turn feeds a transportation vehicle. In certain embodiments, the product storage vessel 328 is pressurizable. In certain embodiments, the product storage vessel 328 includes a circulating pump, agitator, bubble column pump, and/or other agitating or stirring device.

Figure 4:
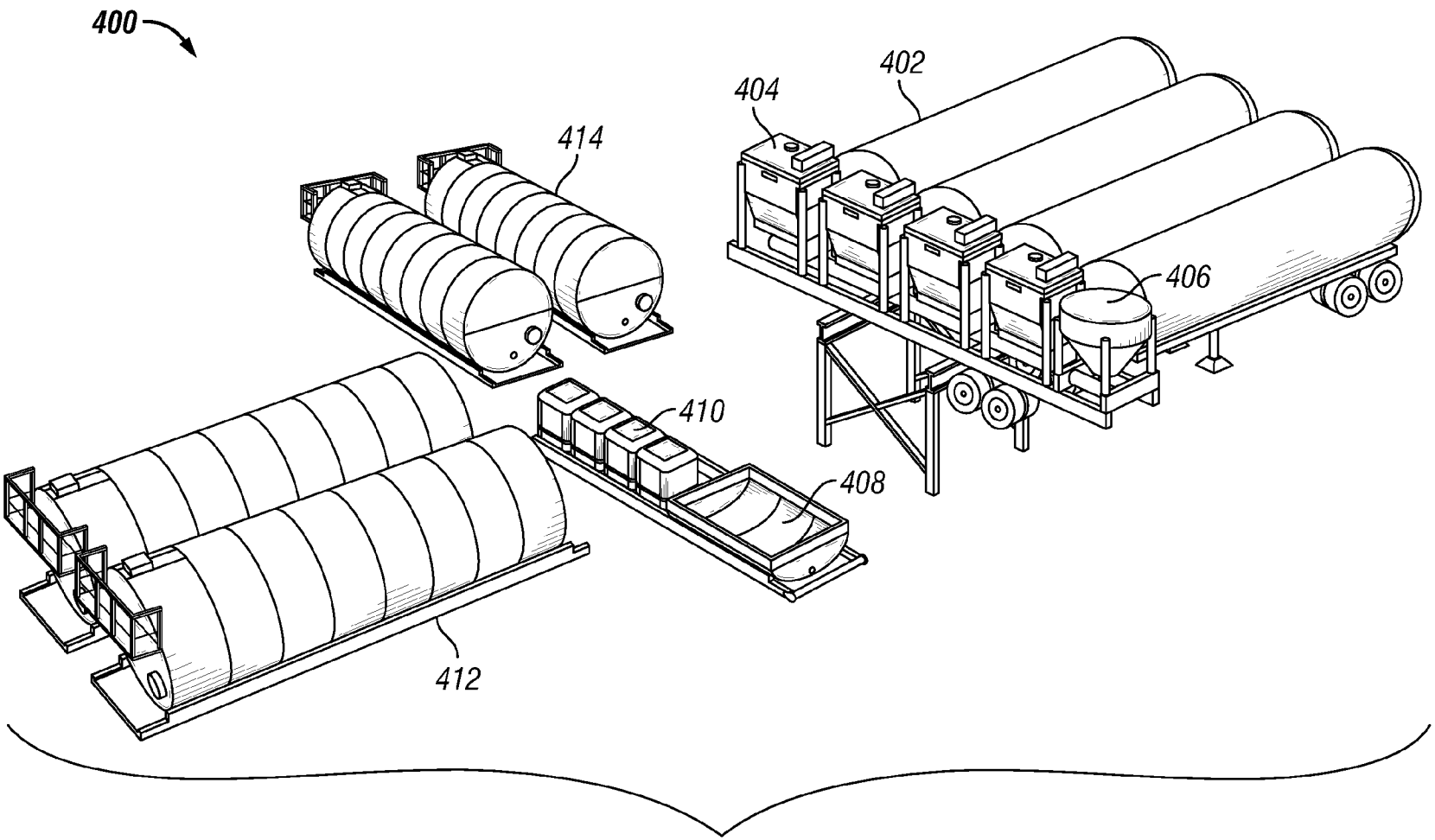
FIG. 4 is a schematic representation of a pilot plant for preparing treatment fluids according to some embodiments of the current application.

Referencing to FIG. 4, an example pilot plant 400 is illustrated. The pilot plant 400 may include a number of bulk storage vessels 402. Example storage of bulk materials includes cone bottom vessels that may be readily emptied through the bottom. In some instances augers may be used to pull material from the bottom of the storage vessel and move it to the mixing area. In some cases, a plant uses tanks that can be pressurized and pneumatically convey the material, which allows more flexible location of the bulk storage and makes combining storage units more feasible. In some cases, a storage system may include equipment provided to pressurize and convey the product with heated and/or dried air. This allows the product to be raised above the freezing point, avoiding the product freezing in the mixing system when water is added. In some cases, the pilot plant 400 may include an area where the bulk delivery carriers (e.g. rail cars) may be parked after delivering bulk materials to the plant. In such an event, the carriers themselves can be used as the storage for the plant, rather than having separate storage vessels.

The pilot plant 400 may further include a number of batching vessels 404. Each batching vessel 404 may be operationally coupled to a load cell (not shown), so that the batching vessel 404 may provide prescribed amounts of each particle from the bulk storage vessels 402. Examples of batch measurement of bulk materials include accumulative and/or decumulative weigh batching, which involves the use of a storage device (or batcher) mounted on load cells where the amount of powder can be determined by weighing the batcher. Accumulative methods measure the accumulation of powder delivered to the batcher. Once the appropriate amount is in the batcher, delivery is stopped and the powder may be supplied to the mixing system. Decumulative batching uses a large storage vessel where the movement of powder out of the vessel is measured. An example batch measurement system includes a batcher that is slightly larger than needed, where the batcher is filled by weight to slightly more than needed. Then, powder is extracted and a more precise measurement is made by decumulation.

Alternatively or additionally, batch measurement is achieved by direct control of the moving product. In certain embodiments, calibrated feeders (such as screw, belt, air-lock, starwheel, or vibratory feeders) are used. In certain other embodiments, flow measuring devices (such as flow meters, mass flow meters, impact particle flow meters, etc.) are used.

A fluid vessel 406 may be provided along the batching vessels 404. The batching vessels 404 and the fluid vessel 406 can be loaded on a raised trailer, as illustrated in FIG. 4, which can provide convenient loading or passing to a mixer (not shown) positioned underneath the raised trailer. The batching vessels 404 may provide particles to the mixer through a screw feeder or other feeding device, as can be understood by people skilled in the art.

The pilot plant 400 may further include a number of carrying medium vessels 414. The carrying medium vessels 414 may contain water, brine, as well as any other suitable carrying medium. Different carrying medium vessels 414 may contain the same type of liquid or distinct types of liquid. The pilot plant 400 further includes a number of additive vessels 410. The additive vessels 410 may contain chemicals, gelling agents, acids, inhibitors, breakers, or any other type of additive to be combined with the carrying medium. The skid including the additive vessels 410 may further include a batching tub 408. The final mixed product can be stored in finished product storage 412.

The units at the example pilot plant 400 are shown as skid loaded and transportable by standard highway vehicles. In certain embodiments, the entire bulk facility 202 can be made from skid loaded and/or transportable units. In certain embodiments, a portion or the whole bulk facility 202 are permanently constructed at a location.

The use of a centralized facility 202 and/or a pilot plant 400 provides for enhanced quality assurance and quality control of treatment fluids use at the wellsite. The facility 202 ensures that fluids are being generated in a uniform fashion and with uniform source materials (e.g. the same water source). Additionally, the mixing and material delivery equipment is not being moved or adjusted, and individual pieces of equipment are not being changed out—avoiding, for example, part to part variability that occurs when different styles of blenders are present on separate locations due to equipment availability. Further, the mixing and material delivery equipment at the facility 202 is not constrained to the same mobility requirements that apply to wellsite mixing and material delivery equipment, allowing for higher equipment quality and precision. In certain embodiments, a crew or crews working the facility 202 or pilot plant 400 may also have a more stable composition over time, for example relative to the composition of hydraulic fracturing crews, so that variability due to personnel is also minimized.

Still further, the centralized location of the fluid product provides one geographic location for testing one or more fluid features with precision. For example, a single unit of expensive testing equipment can thereby test all relevant treatment fluids for the region serviced by the facility 202 or pilot plant 400. Additionally, any complex or time consuming testing procedures can be performed at the facility 202 or pilot plant 400, avoiding travel costs and risks for testing personnel to be available at individual wellsite locations. In certain further embodiments, the automation and control elements available due to the presence of a controller 1002 (see the description referencing FIG. 10) provide for improved treatment fluid uniformity, quality assurance (e.g. feedforward fluid quality management), and quality control (e.g. feedback fluid quality management) over treatment fluids that are individually batched or generated in real-time for each treatment at wellsite locations.

An example centralized facility 202 and/or a pilot plant 400 provides an improved system-wide environmental impact by decoupling the wellsite location from the facility 202 location. For example, the facility 202 and/or pilot plant 400 can be provided in an area that is not environmentally sensitive (e.g. an industrially zoned area), avoiding areas that are environmentally sensitive. Example and non-limiting environmental sensitivities include zoning constraints, access constraints, noise considerations, the presence of endangered species, wetlands, and/or amicability considerations. Additionally or alternatively, the facility 202 and/or pilot plant 400 can be provided in an area that enables environmental management, such as carbon capture, fluid disposal, and/or fluid treatment that is not equivalently available at an individual wellsite.

In certain additional or alternative embodiments, the use of a centralized facility 202 and/or a pilot plant 400 provides for an improved environmental impact of the treatment fluid generation system. In one example, the facility 202 can be co-located with treatment facilities and/or disposal facilities. As an example, carbon capture facilities (e.g. a disposal well) may be present to store carbon dioxide emissions from various powered equipment at the facility 202. Any chemical or fluid effluents from the facility 202 can be treated into neutral products and/or stored in a disposal facility (e.g. a separate disposal well, the same disposal well, and/or a separate geological zone within the disposal well). Additionally, the facility 202 and related equipment is not constrained to be highly mobile, and accordingly enhanced environmental equipment (e.g. dust catchers, sound mufflers, etc.) may be present that would be inconvenient or expensive to include on wellsite mobile equipment. In other embodiments the recirculation may be accomplished using the pressure provided by pressurizing pump 512 and simply having hoses from the pump sumps leading back to the tanks 503 or the low pressure manifold 504.

Figure 5:
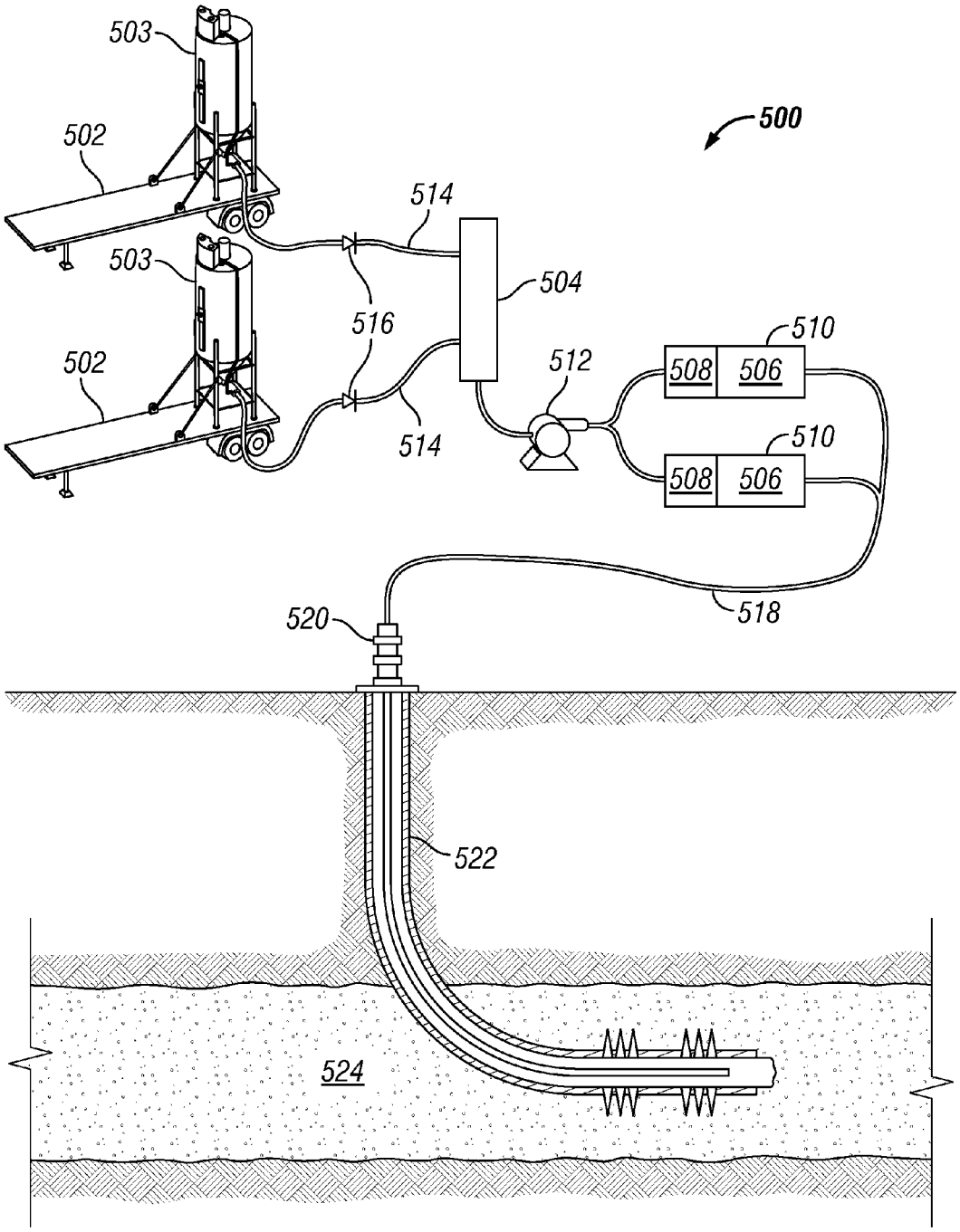
FIG. 5 is a schematic representation of the use of the treatment fluid at a wellsite according to some embodiments of the current application.

Referencing to FIG. 5, a system 500 for treating a formation 524 fluidly coupled to a wellbore 522 via a wellhead 520 is shown. The system 500 may include one or more wellsite transportation vehicles 502 having one or more vessels 503 for providing mixed product fluid to a low pressure manifold 504. The low pressure manifold 504 may be fluidly coupled to the suction side 508 of fracturing pumps 510. The fracturing pumps 510 may include a high pressure side 506 fluidly coupled through a high pressure line 518 to a wellhead 520. The system 500 may further include a circulation pump 512 such as a centrifugal pump on the low pressure side to facilitate the flow of the low pressure fluid from the low pressure manifold 504 to the fracturing pumps 510.

The system 500 may further include one or more check valves 516 positioned between the low pressure manifold 504 and the vessels on the wellsite transportation vehicles 502. Additional or alternative, the system 505 may be a system that includes a means for adding a gel pill (e.g. a gel pill fluid source and pressurizing pump), a system without a low pressure manifold 504, a system with one or more fracturing pumps dedicated to particle free solution delivery (which may be coupled to a high pressure manifold), and/or a system with a fluid tank and fluid tank delivery pressure mechanism (e.g. sufficient hydraulic pressure from the orientation and/or raising of the fluid tank, pressurizing pump for the fluid tank, etc.).

The wellbore 522 may be cased and/or cemented into the ground. Alternatively or additionally, the wellbore 522 may be open or otherwise unfinished or uncompleted. The wellbore 522 may be a vertical well or a horizontal well, as shown in FIG. 5. The formation 524 may be an oil formation, a shale gas formation, or a formation bearing any other type of hydrocarbon or natural resource that is interesting to the operator, or a formation suitable for storing oil, gas or other type of hydrocarbon or natural resources that is interesting to the operator.

An example procedure that can be implemented by system 500 may include performing the fracture treatment where no blender is present at the location. An example procedure may further include an operation to recirculate a sump of the positive displacement pump during the pumping. The operation to recirculate the sump and/or suction side of the positive displacement pump includes operating a recirculating pump fluidly coupled to the sump/suction side of the fracturing pump. In certain embodiments, a dedicated pump (not shown) pumps into or pulls from the sump to clean out and/or prevent sanding off in the sump.

Figure 6:
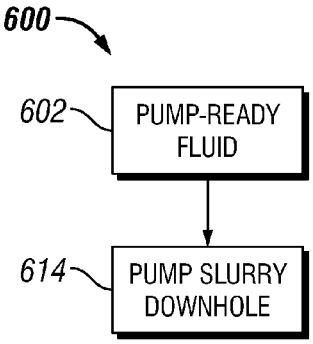
FIG. 6 is a schematic representation of a treatment fluid preparation system according to some embodiments of the current application.

Referencing FIG. 6, an example operation 600 includes a pump-ready fluid 602 that is prepared at a facility 202 and transported to the wellsite via a transportation vehicle 502. The pump-ready fluid 602 can then be pumped downhole in operation 614. Accordingly, in certain embodiments, a fracturing operation is performed without a proppant vehicle (sand truck, sand chief, etc.) and/or a blender (e.g. a POD blender) present on the location. In certain embodiments, the fracturing operation is performed without a continuous mixer provided on the location. In certain embodiments, the fracturing operation is performed without a continuous mixer and without pre-batching fracturing fluid into tanks provided on the location, including large water tanks (e.g. 400 BBL tanks). The footprint needed at the wellsite for a fracturing operation can be significantly reduced.

Figure 7:
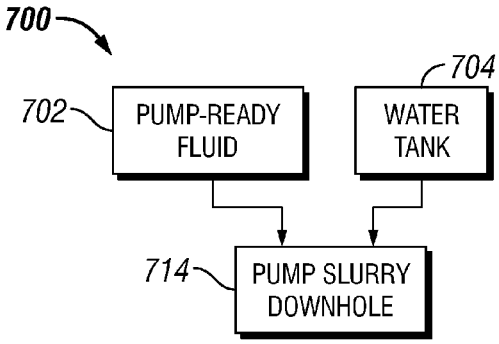
FIG. 7 is another schematic representation of a treatment fluid preparation system according to some embodiments of the current application.

FIG. 7 illustrates a fracturing operation 700 which, in addition to the embodiment represented in FIG. 6, further includes one or more water tanks 704. In certain embodiments, the water tanks 704 can be used to provide flush and/or displacement fluids. Additionally or alternatively, the water tanks 704 can be used to provide dilution water to bring a concentrated pump-ready fluid 702 down to a designed particle content and/or density before the operation 714 to pump the slurry downhole. The pump-ready fluid 702 and/or water tanks 704 are provided, in certain embodiments, with sufficient inherent pressure (e.g. through elevation, fluid depth, head tanks, etc.) that a blender or other pressurizing equipment is not required to feed the pump-ready fluid 702 and/or water from the water tanks 704 to the fracturing pumps. Moreover, in certain embodiments, a fracturing operation is performed without a proppant vehicle (sand truck, sand chief, etc.) and/or a blender (e.g. a POD blender) present on the location. In certain embodiments, the fracturing operation is performed without a continuous mixer provided on the location. Therefore, the footprint needed at the wellsite for a fracturing operation can still be significantly reduced.

Figure 8:
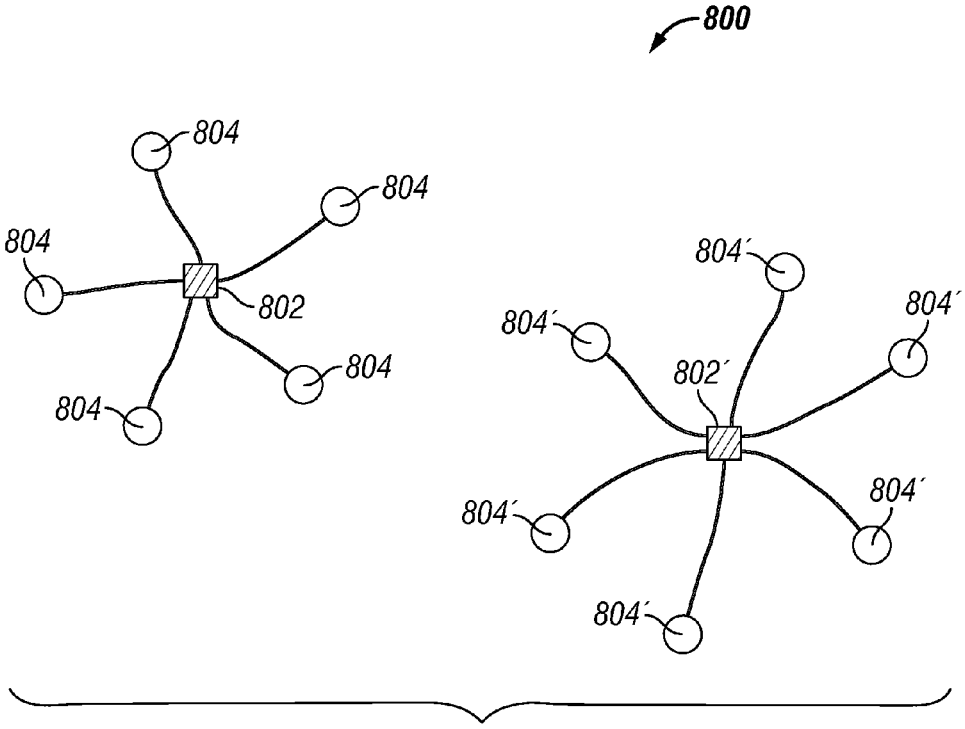
FIG. 8 is a schematic representation of a treatment fluid preparation system with a different setup from FIG. 2.

FIG. 8 illustrates a variation to the treatment fluid preparation and delivery system 200 in FIG. 2. Here, a system 800 is provided which includes a number of points of interest 804 and one or more facilities 802, 802' positioned among a plurality of points of interest 804, 804' in a "hub and spokes" fashion. The plurality of points of interests can be wellbores, water sources, proppant sources, additive sources, etc. An example positioning includes a center-of-geography position, a central location, a location minimizing a total trip time between a plurality of point of interests 804, 804' and their corresponding facility 802, 802' and/or any position selected in response to one of the described positions. An example position selected in response to one of the described positions includes a position nominally selected according to a centralization criterion with respect to the point of interests 804, 804' and repositioned specifically to an available location, a pre-existing facility or graded area, etc. In certain embodiments, the facility 802, 802' is selected to be not greater than a predetermined distance from each of a plurality of points of interest 804, 804' such as 5 miles, 10 miles, 15 miles, or 20 miles from each of a plurality of wellbore 804, 804'.

In certain further embodiments, each point of interest 804, 804' is associated with one or more facilities 802, 802'. In certain embodiments, a facility 802, 802' is a fracture fluid batching facility, for example as illustrated in FIGS. 2, 3, and/or 4. In certain embodiments, a facility 802, 802' is an area structured to receive a fracture fluid batching facility, for example as illustrated in FIGS. 2, 3, and/or 4. An example system 800 may also include a fracture fluid batching facility that moves from facility 802 to facility 802' according to the group of points of interests (such as wells) 804, 804' presently being treated.

Figure 9:
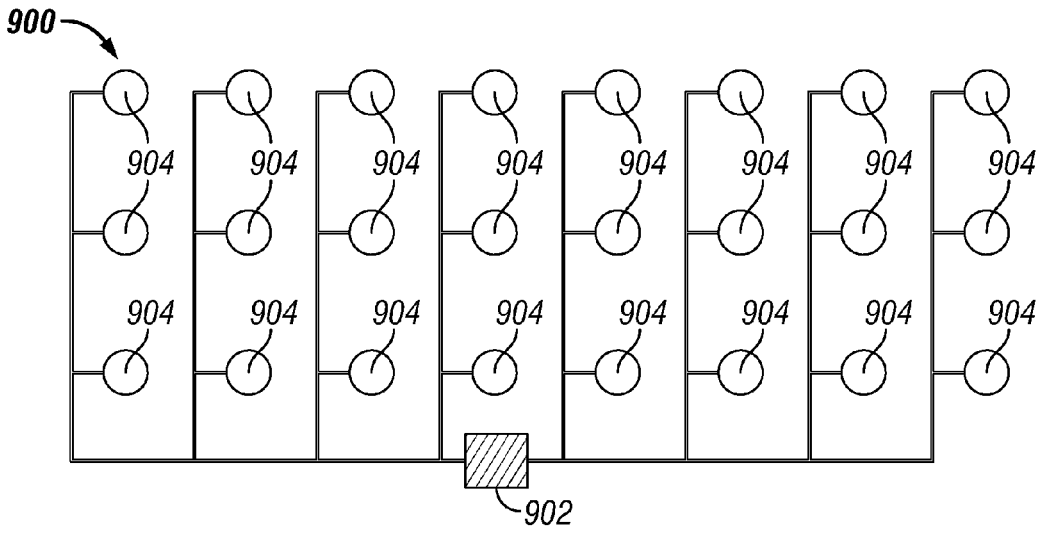
FIG. 9 is a schematic representation of a treatment fluid preparation system with yet another different setup from FIG. 2.

FIG. 9 illustrates another variation to the treatment fluid preparation and delivery system 200 in FIG. 2. Here, a system 900 is provided which includes a number of wellbores 904 that are positioned on a single operation site (e.g. a directional drilling PAD), and one or more treatment fluid preparation and delivery facilities 902 positioned on the same operation site. The facility 902 provides pump-ready treatment fluid to the wellbores 904.

In certain embodiments, a method is disclosed for preparing a pump-ready fluid. An example method includes providing a carrier fluid fraction, providing an immiscible substance fraction including a plurality of particles such that a packed volume fraction (PVF) of the particles exceeds 64%, and mixing the carrier fluid fraction and the immiscible substance fraction into a treatment slurry. In certain embodiments, the immiscible substance fraction exceeds 59% by volume of the treatment slurry. The method includes providing the treatment slurry to a storage vessel. The storage vessel may be a vessel at a facility 202 or pilot plant 400. In certain embodiments, the method includes positioning the storage vessel at a wellsite. In certain embodiments, the storage vessel is not fluidly coupled (in fluid communication) to a wellbore at the wellsite. The storage vessel may be fluidly coupleable to a wellbore at the wellsite, and/or the storage vessel may be a vessel that is transportable to the wellsite, and/or a storage vessel configured to couple to and transfer the pump-ready fluid to a transporting device.

In certain embodiments, the method includes positioning the storage vessel at a wellsite, and/or positioning the storage vessel vertically, for example where the storage vessel is a vertical silo. An example vertical silo includes a frame attached to the silo that deploys the silo from the transport vehicle, and reloads the silo to the transport vehicle after the treatment. Another example vertical silo is a modular and stackable silo, which may include an external frame for the silo. Another example vertical silo is raiseable directly on the transport vehicle, for example as shown in FIG. 5. Certain examples of vertical silos that can be used in the current application are described in U.S. Patent Application Pub. No. US 2011/0063942, and in PCT Patent Application Pub. No. WO 2009/030020 A1, both of which are incorporated herein in the entirety for all purposes.

In certain embodiments, the method includes fluidly coupling the storage vessel to a pump intake, and treating a wellbore with the treatment slurry. In certain embodiments, the method further includes providing all of a proppant amount for the treating of the wellbore within the treatment slurry. Stated differently, in certain embodiments no proppant is added to the treatment slurry after the pump-ready treatment fluid is prepared. Accordingly, the treating equipment omits, in certain embodiments, a proppant delivery vehicle (e.g. sand truck and/or sand Chief) and/or a blender (e.g. a POD blender).

In certain further embodiments, the method includes performing the operations of: providing the carrier fluid fraction, providing the immiscible substance fraction, and mixing the carrier fluid fraction, at a facility remote from a wellsite. The wellsite is any one of the wellsites intended to be served by the facility, and/or intended as the treatment target for the treatment slurry. An example facility includes a powered device to perform at least one of the providing and mixing operations, and an example method further includes capturing an emission (such as carbon dioxide) of the powered device. An example capturing operation includes capturing the emission and may further include disposal of the emission. An example of disposal include injecting the carbon dioxide into a disposal well operationally coupled to the facility, although any emission capture operation known in the art is contemplated herein. In certain embodiments, the method further includes capturing and disposing of a treatment fluid byproduct at the facility remote from the wellsite. The disposing of the treatment fluid byproduct includes any treating operation to render the treatment fluid byproduct harmless, and/or direct disposal of the treatment fluid byproduct, for example into a disposal well. The disposal well for captured carbon the disposal well for the treatment fluid byproduct may be the same or distinct wells, and the geological formations for disposal within the disposal well may be the same or distinct formations.

In certain further embodiments, an example method includes selecting a location for the facility remote from the wellsite by selecting a location having an enhanced location profile relative to a location profile of the wellsite, where the wellsite is an intended treatment target for the treatment slurry. The determination of an enhanced location profile may be made with respect to any special consideration. Example and non-limiting location considerations include environmental, zoning, regulatory, situational, and/or amicability considerations. Examples include locating the facility in an industrial zoned area, locating the facility away from environmentally sensitive areas, locating the facility where adequate disposal is present or can be made available, locating the facility in an area supported by nearby property owners or local governments, etc.

Figure 10:
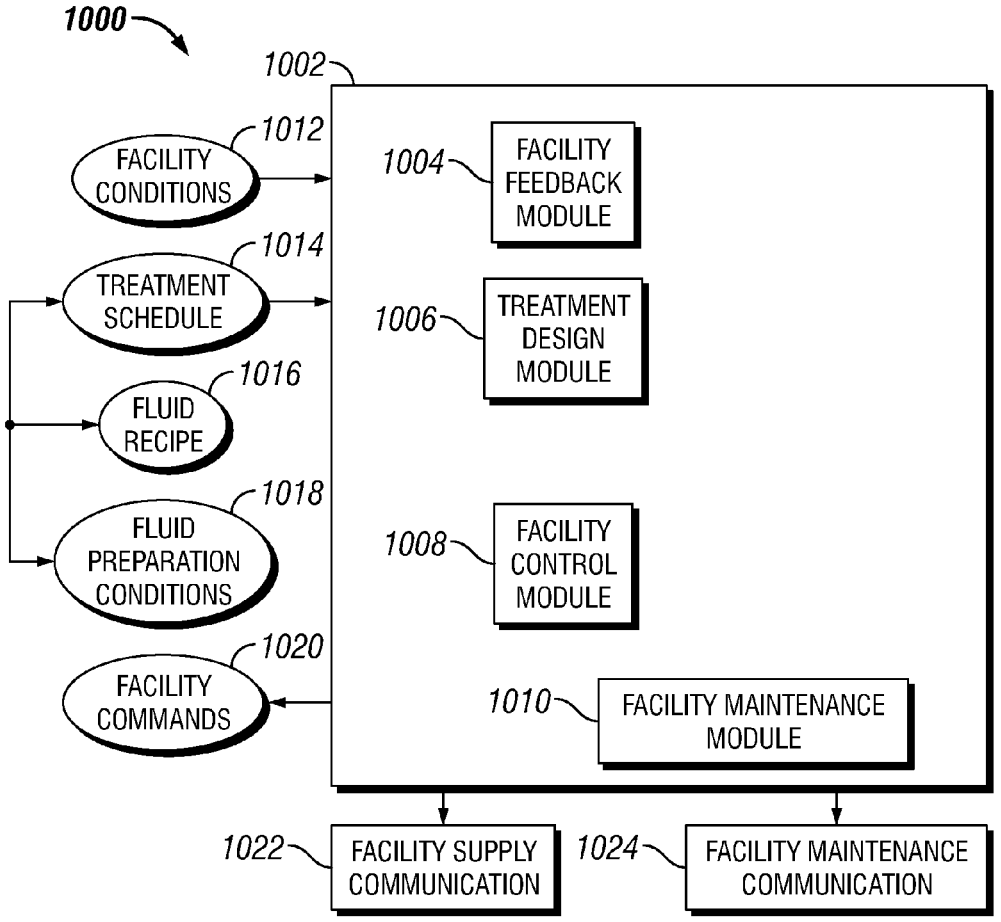
FIG. 10 is a schematic representation of a control unit for the treatment fluid preparation system according to some embodiments of the current application.

Referring to FIG. 10, a control unit 1000 can be included in any of the treatment fluid preparation and delivery system 200, 800, 900 described above. The control facility 1000 can be structured to communicate with and/or control any or all aspects of a facility 202, 802, 902. In certain embodiments, the control unit 1000 can be structured to remotely communicate with and/or control any or all aspects of a facility 202, 802, 902 and/or a pilot plant 400. Remote communication and/or control can accomplished through any means understood in the art, including at least wireless, wired, fiber optic, or mixed communications network, and/or through internet or web-based access.

The control unit 1000 may include a controller 1002 structured to functionally execute operations to communicate with and/or control the facility 202, 802, 902. In certain embodiments, the distance of communication exceeds 250 miles, although any other distance can be contemplated. In certain embodiments, the controller 1002 forms a portion of a processing subsystem including one or more computing devices having memory, processing, and communication hardware. The controller 1002 may be a single device or a distributed device, and the functions of the controller may be performed by hardware or software. The controller 1002 may be in communication with any sensors, actuators, i/o devices, and/or other devices that allow the controller to perform any described operations.

In certain embodiments, the controller 1002 may include one or more modules structured to functionally execute the operations of the controller. In certain embodiments, the controller includes facility feedback module 1004, a treatment design module 1006, and a facility control module 1008. An example facility feedback module 1004 may interpret facility conditions, including temperatures, pressures, actuator positions and/or fault conditions, fluid conditions such as fluid density, viscosity, particle volume, etc., and supply indications for various materials at the facility. An example treatment design module 1006 may interpret a treatment schedule, a fluid recipe, and/or fluid preparation conditions. An example facility control module 1008 may provide facility commands in response to the facility conditions and the treatment schedule, wherein one or more actuators or display units at the facility are responsive to the facility commands. In certain embodiments, the controller 1002 further includes a facility maintenance module 1010. An example facility maintenance module 1010 may provide a facility supply communication and/or a facility maintenance communication in response to the facility conditions and/or the treatment schedule.

The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or software on computer readable medium, and modules may be distributed across various hardware or software components. Moreover, certain operations described herein include operations to interpret one or more parameters. Interpreting, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a computer readable medium, receiving the value as a run-time parameter by any means known in the art including operator entry, and/or by receiving a value by which the interpreted parameter can be calculated, and/or by referencing a default value that is interpreted to be the parameter value.

Referencing back to FIG. 10, an example controller 1002 forming a portion of a control unit 1000 is described. The controller 1002 may includes a facility feedback module 1004, a treatment design module 1006, and a facility control module 1008. An example facility feedback module 1004 interprets facility condition(s) 1012. Example and non-limiting facility conditions include any temperature at the facility (e.g. of a fluid, product, ambient temperature, a temperature of any actuator, etc.), any pressure at the facility, a feedback response of any actuator position or state, an amount of any material present at the facility, and measured fluid conditions such as fluid density, viscosity, particle volume, etc., and/or a fault or diagnostic value of any equipment at the facility.

The example controller 1002 further includes a treatment design module 1006. The example treatment design module 1006 interprets a treatment schedule 1014. An example treatment schedule 1014 includes information relevant to a production fluid to be produced at the facility. An example treatment schedule 1014 may include a fluid type, fluid amount, fluid ingredients, and fluid characteristics, such as density, viscosity, particle volume, etc. The fluid type may be a quantitative or qualitative description. The controller 1002 in certain embodiments accesses stored information to determine the formulation of a qualitatively described fluid. In certain embodiments, the treatment schedule 1014 includes a number of fluids, a trajectory of fluids (e.g. a fluid density or proppant density ramp), and/or a sequence of fluids.

In certain embodiments, the treatment schedule 1014 further includes a fluid recipe 1016. An example and non-limiting fluid recipe 1016 may include a list of ingredients to be mixed to provide the pump-ready treatment fluid, the amount of each ingredient, a mixing schedule (e.g. a first particle type to be added first, and a second particle type to be added second, etc.), a gelling schedule, a breaker schedule, a desired fluid density and viscosity, etc. Any fluid formulation information that is actionable by the facility is contemplated herein as a potential aspect of the treatment schedule 1014 and/or fluid recipe 1016. Additionally or alternatively, the treatment schedule 1014 may further include fluid preparation conditions 1018. Example and non-limiting fluid preparation conditions 1018 include fluid shear rates, hydration times, hydration temperatures, etc. In certain embodiments, information may overlap between the fluid recipe 1016 and the fluid preparation conditions 1018.

The example controller 1002 may further include the facility control module 1008. The facility control module 1008 provides facility commands 1020 in response to the facility conditions 1012 and the treatment schedule 1014, the fluid recipe 1016, and/or the fluid preparation conditions 1018. In certain embodiments, the facility commands 1020 are direct commands to actuators of the facility. Additionally or alternatively, the facility commands 1020 provide instructions that indirectly cause operations at the facility—for example communicated information to a display device (computer monitor, printout, etc.). Example facility commands 1020 provide the actions that create the fluid according to the treatment schedule 1014, adjust facility operations according to the measured fluid conditions such as fluid density, viscosity, particle volume, etc., and/or provide the actions that create a fluid acceptably close to the fluid according to the treatment schedule 1014, for example substituting products according to availability, etc.

The example controller 1002 may further include a facility maintenance module 1010 that provides a facility supply communication 1022 and/or a facility maintenance communication 1024 in response to the facility conditions 1012 and/or the treatment schedule 1014 including the fluid recipe 1016 and/or the fluid preparation conditions 1018. An example includes any actuator or sensor fault or diagnostic indicator at the facility may be provided by the facility maintenance module 1010, for example as a facility maintenance communication 1024 that is communicated to notify a maintenance operator of the condition. In certain embodiments, a facility condition 1012 indicating that a fluid constituent is not available in sufficient quantities or is running low may be communicated as a facility supply communication 1022. The described usages of the facility supply communication 1022 and the facility maintenance communication 1024 are examples and non-limiting. Without limitation, any indication that an aspect of the facility is non-functional, degrading, running low, below a predetermined threshold value, and/or of an unknown status may be communicated by the facility maintenance module 1010 and/or controller 1002.

While the disclosure has provided specific and detailed descriptions to various embodiments, the same is to be considered as illustrative and not restrictive in character. Only certain example embodiments have been shown and described. Those skilled in the art will appreciate that many modifications are possible in the example embodiments without materially departing from the disclosure. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. In the claims, means-plus-function clauses are intended to cover the structures described herein as performing the recited function and not only structural equivalents, but also equivalent structures. For example, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

We claim:

1. A method, comprising:

preparing a pump-ready fracturing fluid comprising a carrying medium and an immiscible substance, wherein a volume fraction of the immiscible substance in the pump-ready fracturing fluid is 40% or more;

delivering the pump-ready fracturing fluid to a location operationally coupled to a wellsite;

providing the pump-ready fracturing fluid to a pump; and pumping the pump-ready fracturing fluid into a subterranean formation fracturing the subterranean formation wherein the immiscible substance comprises a plurality of particles such that a packed volume fraction (PVF) of the particles exceeds 64%.

2. The method of claim 1, wherein the pump-ready fracturing is provided to the pump without passing through a blender.

3. The method claim 1, wherein the pump-ready fracturing fluid is provided to the pump without passing through a mixer.

4. The method of claim 1, further comprising recirculating a sump side of the pump during the pumping.

5. The method of claim 1, further comprising pumping an alternate fluid pill during the pumping.

6. The method of claim 1, wherein a volume fraction of the immiscible substance in the pump-ready fracturing fluid is 50% or more.

7. The method of claim 6, wherein a volume fraction of the immiscible substance in the pump-ready fracturing fluid is 60% or more.

8. The method of claim 7, wherein a volume fraction of the immiscible substance in the pump-ready fracturing fluid is 70% or more.

9. The method of claim 8, wherein a volume fraction of the immiscible substance in the pump-ready fracturing fluid is 80% or more.

10. The method of claim 1, wherein the packed volume fraction (PVF) of the particles exceeds 74%.

11. The method of claim 10, wherein the packed volume fraction (PVF) of the particles exceeds 87%.

* * * * *